US010822126B2

(12) United States Patent
Johnson et al.

(10) Patent No.: US 10,822,126 B2
(45) Date of Patent: Nov. 3, 2020

(54) ONE-WAY CLUTCH ARRANGEMENT FOR STRETCH WRAPPING MACHINE

(71) Applicant: Lantech.com, LLC, Louisville, KY (US)

(72) Inventors: Richard L. Johnson, LaGrange, KY (US); Curtis W. Martin, Georgetown, IN (US)

(73) Assignee: LANTECH.COM, LLC, Louisville, KY (US)

( * ) Notice: Subject to any disclaimer, the term of this patent is extended or adjusted under 35 U.S.C. 154(b) by 188 days.

(21) Appl. No.: 16/096,923

(22) PCT Filed: Apr. 27, 2017

(86) PCT No.: PCT/US2017/029898
§ 371 (c)(1),
(2) Date: Oct. 26, 2018

(87) PCT Pub. No.: WO2017/189875
PCT Pub. Date: Nov. 2, 2017

(65) Prior Publication Data

US 2019/0118982 A1 Apr. 25, 2019

Related U.S. Application Data

(60) Provisional application No. 62/329,181, filed on Apr. 28, 2016.

(51) Int. Cl.
*B65B 11/02* (2006.01)
*B65B 41/16* (2006.01)
(Continued)

(52) U.S. Cl.
CPC ..... *B65B 11/025* (2013.01); *B65B 11/045* (2013.01); *B65B 41/16* (2013.01);
(Continued)

(58) Field of Classification Search
CPC ..... B65B 11/025; B65B 11/04; B65B 11/045; B65B 41/16; B65B 57/04;
(Continued)

(56) References Cited

U.S. PATENT DOCUMENTS 4,905,455 A * 3/1990 Horner ..... B65B 11/045 53/441
4,914,891 A 4/1990 Suolahti
(Continued)

FOREIGN PATENT DOCUMENTS

EP 0246659 A1 * 11/1987 ..... B65B 11/045
EP 1502856 A1 2/2005
(Continued)

OTHER PUBLICATIONS

European Patent Office; Communication for EP Application No. 17790446.3 dated May 11, 2020 (423EP1).
(Continued)

*Primary Examiner* — Stephen F. Gerrity
(74) *Attorney, Agent, or Firm* — Middleton Reutlinger

(57) ABSTRACT

A one-way clutch arrangement may be provided on a packaging material dispenser of a stretch wrapping machine in part to provide differing rates of rotation for upstream and downstream pre-stretch rollers in forward and reverse directions of the packaging material dispenser.

41 Claims, 11 Drawing Sheets

(51) Int. Cl.

| | |
|---|---|
| ***B65B 57/04*** | (2006.01) |
| ***B65B 11/04*** | (2006.01) |
| ***B65B 65/00*** | (2006.01) |
| *B65B 11/00* | (2006.01) |

(52) U.S. Cl.
CPC ..... *B65B 57/04* (2013.01); *B65B 65/006* (2013.01); *B65B 2011/002* (2013.01); *B65B 2210/18* (2013.01)

(58) Field of Classification Search
CPC ..... B65B 2011/002; B65B 2210/14; B65B 2210/16; B65B 2210/18; B65B 2210/20
USPC .... 53/399, 441, 556, 587, 588, 389.1, 389.4
See application file for complete search history.

(56) References Cited

U.S. PATENT DOCUMENTS

| | | | | |
|---|---|---|---|---|
| 5,016,427 | A * | 5/1991 | Thimon et al. | B65B 41/16 53/399 |
| 5,107,657 | A | 4/1992 | Diehl et al. | |
| 5,421,141 | A | 6/1995 | Gordon | |
| 5,768,862 | A | 6/1998 | Mauro | |
| 6,276,116 | B1 | 8/2001 | Annila et al. | |
| 6,349,867 | B1 | 2/2002 | Fernfors | |
| 6,402,083 | B1 | 6/2002 | Horn et al. | |
| 6,494,400 | B1 | 12/2002 | Zitella et al. | |
| 6,547,179 | B1 | 4/2003 | Klas | |
| 6,553,746 | B1 | 4/2003 | Cere' | |
| 6,684,612 | B2 | 2/2004 | Trottet | |
| 6,772,573 | B2 | 8/2004 | Federeszyn | |
| 6,851,252 | B2 | 2/2005 | Maki-Rahkola et al. | |
| 6,889,488 | B2 | 5/2005 | Maki-Rahkola et al. | |
| 6,901,724 | B2 | 6/2005 | Tale'et al. | |
| 7,111,438 | B2 | 9/2006 | Arima | |
| 7,134,625 | B2 | 11/2006 | Lehrieder et al. | |
| 7,178,317 | B1 | 2/2007 | Koskela | |
| 7,314,197 | B2 | 1/2008 | Tonohara et al. | |
| 7,426,809 | B2 | 9/2008 | Arima | |
| 7,533,515 | B1 | 5/2009 | Koskela | |
| 7,540,128 | B2 | 6/2009 | Lancaster, III et al. | |
| 7,568,327 | B2 | 8/2009 | Lancaster, III et al. | |
| 7,631,832 | B1 | 12/2009 | Chen | |
| 7,661,244 | B2 | 2/2010 | Downhill | |
| 7,784,730 | B2 | 8/2010 | Heimrich et al. | |
| 7,832,682 | B2 | 11/2010 | Keller et al. | |
| 7,837,140 | B2 | 11/2010 | Zitella et al. | |
| 8,079,201 | B2 * | 12/2011 | Cere' | B65B 11/025 53/399 |
| 9,016,033 | B2 | 4/2015 | Ciou | |
| 2003/0066269 | A1 | 4/2003 | Federeszyn | |
| 2003/0145563 | A1 * | 8/2003 | Cere' | B65B 11/025 53/588 |
| 2005/0050861 | A1 * | 3/2005 | Suolahti | B65B 11/025 53/556 |
| 2006/0130437 | A1 * | 6/2006 | Tosa | B65B 11/00 53/556 |
| 2007/0102564 | A1 | 5/2007 | Loffler et al. | |
| 2008/0229707 | A1 | 9/2008 | Zitella | |
| 2009/0050731 | A1 | 2/2009 | Loffler et al. | |
| 2009/0235617 | A1 | 9/2009 | Moore et al. | |
| 2010/0025517 | A1 | 2/2010 | Cere' | |
| 2010/0083614 | A1 | 4/2010 | Lancaster, III et al. | |
| 2012/0174533 | A1 | 7/2012 | Lancaster, III | |
| 2013/0104754 | A1 | 5/2013 | Van Amstel et al. | |
| 2014/0174027 | A1 | 6/2014 | Cere'et al. | |
| 2015/0090831 | A1 | 4/2015 | Huber et al. | |

FOREIGN PATENT DOCUMENTS

| | | | | |
|---|---|---|---|---|
| FR | 2579577 A1 * | 10/1986 | ..... | B65B 11/045 |
| FR | 2606365 A1 * | 5/1988 | ..... | B65B 11/045 |

OTHER PUBLICATIONS

European Patent Office; EESR for EP Application No. 17790446.3 dated Dec. 11, 2019 (423EP1).
International Search Report and Written Opinion for PCT/US2017/029894, dated Aug. 17, 2017 (423WO1).
International Search Report and Written Opinion for PCT/US2017/029898, dated Jul. 6, 2017 (423WO2).
Australian Government IP Australia, Examination Report No. 1 for 2017258283 dated Mar. 20, 2019 (423AU1).
European Patent Office; Partial European Search Report for EP Applicatino No. 17790446.3 dated Sep. 6, 2019 (423EP1).
Canadian Intellectual Property Office, Office Action for 3022566 dated Oct. 16, 2019 (423CA1).
Australian Patent Office; Notice of Acceptance in Application No. 2017258283 dated Apr. 16, 2019 (423AU1).

* cited by examiner

ONE-WAY CLUTCH ARRANGEMENT FOR STRETCH WRAPPING MACHINE

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material, e.g., film, around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

With many stretch wrapping machines, packaging material is provided in roll form, generally with the packaging material wound around a hollow spool such as a cardboard tube. A packaging material dispenser generally includes a roll carrier including a shaft or mandrel that projects through the spool and allows the roll to rotate about a longitudinal axis to dispense a web of packaging material from the roll. A series of rollers guide the web of packaging material as the web is dispensed to a load, often with the speeds of at least some of the rollers controlled to pre-stretch the web.

Packaging material, being a consumable item, generally must be replaced from time to time, and in many cases replacement is performed manually by an operator by removing a used or empty roll, loading a new or replacement roll, and then threading the leading end of the web of packaging material wound on the roll through the series of rollers. Depending upon the weight, material and/or thickness of the packaging material, a roll of packaging material can weigh upwards of 50 pounds, and as a result, manually changing out a roll can be time consuming, cumbersome and strenuous.

In addition, stretch wrapping machines can occasionally experience film breaks where a web of packaging material can be severed, e.g., due to imperfections in the packaging material and/or load and/or varying tension in the web. In the least, an operator may be required to rethread the packaging material through the packaging material dispenser rollers and/or clean out any packaging material left in the packaging material dispenser. In some instances, operators may even perform a roll change as a result of a film break.

Particularly with higher speed machines incorporating rotating arms or rings, a desire generally exists to minimize the downtime and thereby maximize the number of loads that can be wrapped within a particular period of time, as well as to minimize labor costs associated with tending to stretch wrapping machines. As a result, some efforts have been made to develop automated roll change systems capable of performing automatic roll changes to reduce downtime and/or manual labor. Existing designs, however, can be complicated and expensive in practice, can occupy a large amount of space adjacent a stretch wrapping machine, can be subject to difficulties in threading a web of packaging material through the rollers of a packaging material dispenser, and can still require substantial labor to manage.

SUMMARY OF THE INVENTION

The invention addresses these and other problems associated with the art by providing in one aspect a method and apparatus that utilize a one-way clutch arrangement in a packaging material dispenser of a stretch wrapping machine in part to provide differing rates of rotation for upstream and downstream pre-stretch rollers in forward and reverse directions of the packaging material dispenser. By doing so, rewind of packaging material back onto a packaging material roll by a pre-stretch assembly is facilitated.

Therefore, consistent with one aspect of the invention, a method of winding packaging material onto a packaging material dispenser roll by a pre-stretch device in a stretch wrapping machine may include providing relative rotation between a load and the packaging material dispenser roll about an axis of rotation to dispense packaging material to the load, driving an upstream pre-stretch roller and a downstream pre-stretch roller by a drive motor, slipping both an upstream pre-stretch pulley and an upstream rewind pulley of the upstream pre-stretch roller relative to the rotation of the upstream pre-stretch roller in an unwind direction of packaging material travel to dispense the packaging material to the load, and locking both the upstream pre-stretch pulley and the upstream rewind pulley of the upstream pre-stretch roller relative to the rotation of the upstream pre-stretch roller in a rewind direction of packaging material travel to wind the packaging material around the packaging material dispenser roll.

Some embodiments may also include contacting the packaging material dispenser roll with the upstream roll to rotate the packaging material dispenser roll, connecting a downstream pre-stretch pulley and a downstream rewind pulley to the downstream pre-stretch roller, operatively connecting the downstream pre-stretch pulley with the upstream pre-stretch pulley, and operatively connecting downstream rewind pulley with the upstream rewind pulley, where the upstream pre-stretch roller rotates with a surface speed that is slower than the downstream pre-stretch roller in the unwind direction of packaging material travel and where the upstream pre-stretch roller rotates with a surface speed that is at least as fast as the downstream pre-stretch roller in the rewind direction of packaging material travel.

Some embodiments may also include feeding the packaging material from the upstream pre-stretch roller to an idle roller and providing the packaging material from the idle roller to the downstream pre-stretch roller. Some embodiments may further include connecting the drive motor, the rewind pulley of the downstream pre-stretch roller and the rewind pulley of the upstream pre-stretch roller by a drive belt. Some embodiments may also include connecting the pre-stretch pulley of the downstream pre-stretch roller to the pre-stretch pulley of the upstream pre-stretch roller by a second belt. Some embodiments may also include locking the pre-stretch pulley of the downstream pre-stretch roller and the rewind pulley of the downstream pre-stretch roller relative to rotation of the downstream pre-stretch roller in both the rewind direction of packaging material travel and the unwind direction of packaging material travel.

In addition, in some embodiments, the pre-stretch pulley of the upstream pre-stretch roller rotates slower than the pre-stretch pulley of the downstream pre-stretch roller. In some embodiments, the rewind pulley of the upstream pre-stretch roller rotates substantially equal to the rotation of the rewind pulley of the downstream pre-stretch roller. Some embodiments may further include providing at least one one-way clutch between the upstream pre-stretch roller and the upstream pre-stretch roller rewind and upstream pre-stretch roller pre-stretch pulleys.

Consistent with another aspect of the invention, a method of winding packaging material onto a packaging material dispenser roll by a pre-stretch device in a stretch wrapping machine may include providing relative rotation between the load and the packaging material dispenser roll about an axis of rotation to dispense a packaging material to the load, passing the packaging material around an upstream pre-stretch roller and a downstream pre-stretch roller of the pre-stretch device, rotating the upstream pre-stretch roller at a predetermined surface speed slower than that of the downstream pre-stretch roller during unwinding of the packaging material from the packaging material dispenser roll, reversing the rotation direction of the upstream pre-stretch roller and downstream pre-stretch roller, and rotating the upstream pre-stretch roller at a predetermined surface speed substantially equal to that of the downstream pre-stretch roller rate during winding of the packaging material onto the packaging material dispenser roll when the rotation direction of the upstream pre-stretch roller and downstream pre-stretch roller is reversed.

Consistent with another aspect of the invention, a method of winding packaging material onto a packaging material dispenser roll by a pre-stretch device in a stretch wrapping machine may include providing relative rotation between the load and the packaging material dispenser roll about an axis of rotation to dispense a packaging material to the load, pre-stretching the packaging material in a pre-stretch device, the pre-stretch device having an upstream pre-stretch roller and a downstream pre-stretch roller, operatively connecting the upstream pre-stretch roller with the downstream pre-stretch roller in a packaging material unwind direction to rotate the downstream pre-stretch roller with at a higher surface speed than that of the upstream pre-stretch roller to pre-stretch the packaging material, and operatively connecting the upstream pre-stretch roller with the downstream pre-stretch roller in a packaging material rewind direction to rotate the upstream pre-stretch roller at a surface speed substantially equal to that of the downstream pre-stretch roller to rewind the packaging material on the packaging material dispenser roll.

In addition, some embodiments may further include driving by a drive motor the downstream pre-stretch roller and the upstream pre-stretch roller. Some embodiments may also include providing the downstream pre-stretch roller with a first and a second pulley, the first pulley having a diameter smaller than that of the second pulley, providing the upstream pre-stretch roller with a first and a second pulley, the first pulley having a diameter smaller than that of the second pulley, connecting the first pulley of the downstream pre-stretch roller with the second pulley of the upstream pre-stretch roller, and connecting the second pulley of the downstream pre-stretch roller with the first pulley of the upstream pre-stretch roller. In addition, in some embodiments, the connecting is by a belt.

In addition, some embodiments may further include freely rotating the first and second pulley of the upstream pre-stretch roller when the upstream pre-stretch roller is rotating in the unwind direction. In addition, some embodiments may further include locking the first and second pulley of the downstream pre-stretch roller to the downstream pre-stretch roller. Some embodiments may further include interposing an idle roller between the upstream pre-stretch roller and the downstream pre-stretch roller to receive the packaging material from the upstream pre-stretch roller. Some embodiments may also include operatively connecting the drive motor to the second pulley of the downstream pre-stretch roller and the first pulley of the upstream pre-stretch roller.

Some embodiments may also include locking the first and second pulley of the downstream pre-stretch roller to the rotation of the downstream pre-stretch roller in both the rewind and the unwind direction, and locking the first and second pulley of the upstream pre-stretch roller to the rotation of the upstream pre-stretch roller in the rewind direction and slipping the first and second pulley in relation to the rotation of the upstream pre-stretch roller in the unwind direction.

Consistent with another aspect of the invention, a pre-stretch dispensing apparatus allowing rewind of a packaging material web dispensed by a dispensing roll may include an upstream pre-stretch roller receiving the packaging material web from the dispensing roll and in contact with the dispensing roll, the upstream pre-stretch roller affixed to an upstream pre-stretch roller shaft, the upstream pre-stretch roller shaft operatively connected to an upstream pre-stretch pulley and an upstream rewind pulley, a downstream pre-stretch roller receiving the packaging material web from the upstream pre-stretch roller, the downstream pre-stretch roller affixed to a downstream pre-stretch roller shaft, the downstream pre-stretch roller shaft operatively connected to a downstream pre-stretch pulley and a downstream rewind pulley, and a motor operatively connected to the downstream rewind pulley and the upstream rewind pulley, where the downstream pre-stretch pulley is operatively connected to the upstream pre-stretch pulley, the upstream pre-stretch pulley and the upstream rewind pulley freely rotate relative to the upstream pre-stretch roller shaft when rotating in a forward dispensing direction and are locked to the rotation of the upstream pre-stretch roller shaft in a rewind direction.

Further, in some embodiments, at least one one-way clutch is interposed between the upstream pre-stretch roller shaft and the upstream pre-stretch pulley and the upstream rewind pulley. Further, in some embodiments, a first one-way clutch is interposed between the upstream pre-stretch roller shaft and the upstream pre-stretch pulley and a second one-way clutch is interposed between the upstream pre-stretch roller shaft and the upstream rewind pulley.

In some embodiments, the downstream rewind pulley and the downstream pre-stretch pulley are locked to the downstream pre-stretch roller shaft. Some embodiments may also include an idle roller interposed between the upstream pre-stretch roller and the downstream pre-stretch roller, the idle roller receiving the packaging material web from the upstream pre-stretch roller. Also, in some embodiments, the upstream rewind pulley has a diameter at least as large as a diameter of the downstream rewind pulley.

In some embodiments, the upstream rewind pulley is substantially the same diameter as the downstream rewind pulley. In some embodiments, a drive belt operatively connects the motor to the downstream rewind pulley and the upstream rewind pulley. Further, in some embodiments, a pre-stretch belt operatively connects the downstream pre-stretch pulley and the upstream pre-stretch pulley. Also, in some embodiments, the idle roller is biased outward away from a rotational axis of the upstream pre-stretch roller shaft.

Consistent with another aspect of the invention, a pre-stretch dispensing apparatus for use in stretch wrapping a load with packaging material may include a packaging material dispenser for dispensing packaging material, the packaging material dispenser configured to support a packaging material roll, an upstream pre-stretch roller and a downstream pre-stretch roller receiving the packaging material from the packaging material roll, the upstream pre-stretch roller and the downstream pre-stretch roller rotatable for pre-stretch of the packaging material, the upstream pre-stretch roller operatively rotatable with the downstream pre-stretch roller to rotate with a slower surface speed than that of the downstream pre-stretch roller in a forward wrapping direction, the upstream pre-stretch roller rotatable with the downstream pre-stretch roller for rewind of the packaging material, the upstream pre-stretch roller operatively rotatable with the downstream pre-stretch roller to rotate with a surface speed substantially equal to that of the downstream pre-stretch roller in a rewind direction.

In some embodiments, an upstream pre-stretch pulley of the upstream pre-stretch roller is connected by a belt to a downstream pre-stretch pulley of the downstream pre-stretch roller. Further, in some embodiments, the upstream pre-stretch pulley is larger in diameter than the downstream pre-stretch pulley. Also, in some embodiments, the upstream pre-stretch roller has a rewind pulley connected to a rewind pulley of the downstream pre-stretch roller. In addition, in some embodiments, the rewind pulley of the upstream pre-stretch roller is connected to the rewind pulley of the downstream pre-stretch roller by a belt. In some embodiments, the upstream pre-stretch roller rewind pulley and the downstream pre-stretch roller rewind pulley are connected to a motor.

Some embodiments may also include a one-way clutch interposed between both the upstream pre-stretch roller rewind pulley and the upstream pre-stretch roller pre-stretch pulley and an upstream pre-stretch roller shaft, the one-way clutch allowing both the rewind pulley and the pre-stretch pulley to freely rotate relative to the upstream pre-stretch roller shaft when rotating in the forward wrapping direction. In addition, in some embodiments, both the downstream pre-stretch roller pre-stretch pulley and downstream pre-stretch roller rewind pulley are keyed to the rotation rate of the downstream pre-stretch roller.

Consistent with another aspect of the invention, an apparatus for wrapping a load with packaging material and allowing rewind of the packaging material may include a packaging material dispenser for dispensing packaging material, a rotational drive configured to provide relative rotation between the packaging material dispenser and the load, and a pre-stretch assembly arranged to receive the packaging material and dispense pre-stretched packaging material. The pre-stretch assembly may include an upstream pre-stretch roller and a downstream pre-stretch roller, the upstream pre-stretch roller receiving packaging material from the packaging material dispenser and providing the packaging material to the downstream pre-stretch roller, the upstream pre-stretch roller and the downstream pre-stretch roller rotatable to pre-stretch the packaging material in a forward direction, the upstream pre-stretch roller rotating with a slower surface speed than that of the downstream pre-stretch roller in the forward direction, the upstream pre-stretch roller and the downstream pre-stretch roller rotatable to rewind the packaging material in a reverse direction, the upstream pre-stretch roller rotating with a surface speed substantially equal to the downstream pre-stretch roller in the reverse direction.

Also, in some embodiments, the upstream pre-stretch roller has a pre-stretch pulley and a rewind pulley, both the pre-stretch pulley and the rewind pulley keyed to the upstream pre-stretch roller in the reverse direction, both the pre-stretch pulley and the rewind pulley freely rotating relative to the upstream pre-stretch roller in the forward direction.

Consistent with another aspect of the invention, a packaging material dispenser may include a packaging material roll carrier configured to support a roll of packaging material, upstream and downstream pre-stretch rollers positioned to receive a web of packaging material from the roll of packaging material supported by the packaging material roll carrier, and a drive mechanism operatively coupling the upstream and downstream pre-stretch rollers to one another to dispense the web of packaging material to a load, the drive mechanism including a one-way clutch arrangement coupled to the upstream pre-stretch roller such that the upstream pre-stretch roller rotates in one direction and with a slower surface speed than that of the downstream pre-stretch roller when dispensing the web of packaging material to the load to pre-stretch the web of packaging material, and where the drive mechanism is configured to drive the upstream pre-stretch roller in an opposite direction and with substantially the same surface speed as that of the downstream pre-stretch roller when rewinding the web of packaging material onto the roll of packaging material.

In addition, some embodiments may also include a bias mechanism coupled to the packaging material roll carrier to bias a surface of the roll of packaging material against the upstream pre-stretch roller such that the roll of packaging material is driven by the upstream pre-stretch roller when the drive mechanism drives the upstream pre-stretch roller in the opposite direction.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Figure 1:
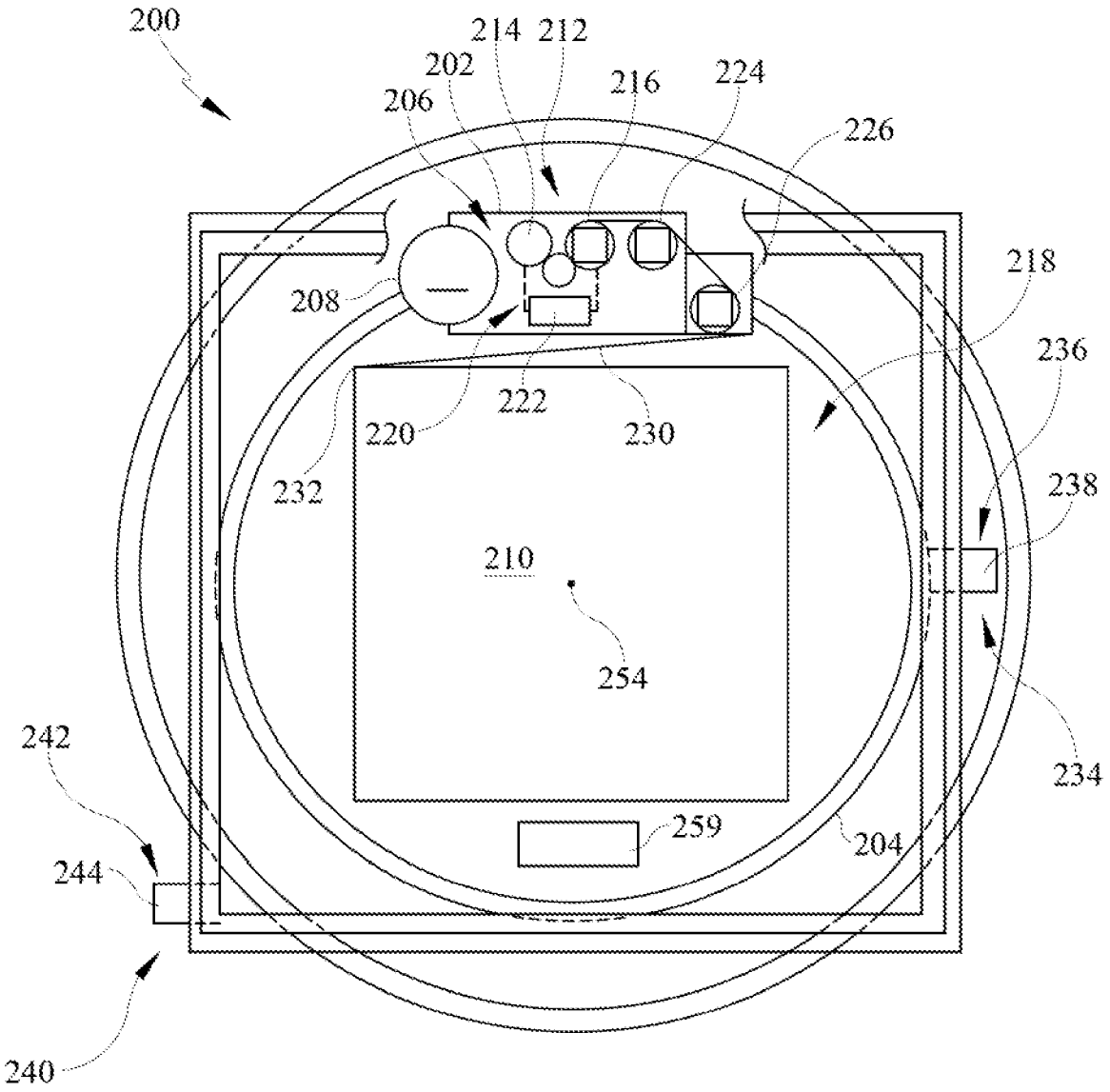
FIG. 1 shows a top view of a rotating ring-type wrapping apparatus consistent with the invention.

Turning to the drawings, wherein like parts are denoted by like numbers throughout the several views, FIG. 1 illustrates a rotating ring-type wrapping apparatus 200, which may include a roll carriage 202 mounted on a rotating ring 204. Roll carriage 202 may include a packaging material dispenser 206. Packaging material dispenser 206 may be configured to dispense packaging material 208 as rotating ring 204 rotates relative to a load 210 to be wrapped. In an example embodiment, packaging material dispenser 206 may be configured to dispense stretch wrap packaging material. As used herein, stretch wrap packaging material is defined as material, e.g., a film, having a high yield coefficient to allow the packaging material a large amount of stretch during wrapping. However, it is possible that the apparatuses and methods disclosed herein may be practiced with packaging material that will not be pre-stretched prior to application to the load. Examples of such packaging material include netting, strapping, banding, tape, film without a high yield coefficient, etc. The invention is therefore not limited to use with stretch wrap packaging material.

Packaging material dispenser 206 may include a pre-stretch assembly 212 including an upstream dispensing roller 214 and a downstream dispensing roller 216, and a packaging material drive system 220, including, for example, an electric or hydrostatic motor 222, may be used to drive dispensing rollers 214 and 216. Downstream of downstream dispensing roller 216 may be provided one or more idle rollers 224, 226, with the most downstream idle roller 226 effectively providing an exit point from packaging material dispenser 206, such that a portion 230 of packaging material 208 extends between the exit point and a contact point 232 where the packaging material engages load 210. It is contemplated that pre-stretch assembly 212 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 208 as it moves from packaging material dispenser 206 to load 210. Movement of an object toward packaging material dispenser 206, away from load 210, and thus, against the direction of flow of packaging material 208, may be defined as "upstream." Similarly, movement of an object away from packaging material dispenser 206, toward load 210, and thus, with the flow of packaging material 208, may be defined as "downstream." Also, positions relative to load 210 (or a load support surface 218) and packaging material dispenser 206 may be described relative to the direction of packaging material flow. For example, when two pre-stretch rollers are present, the pre-stretch roller closer to packaging material dispenser 206 may be characterized as the "upstream" roller and the pre-stretch roller closer to load 210 (or the load support surface 218) and further from packaging material dispenser 206 may be characterized as the "downstream" roller.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210.

In some embodiments, packaging material drive system 220 may be driven by a belt disposed on a fixed ring and in response to rotation of rotating ring 204. In other embodiments, packaging material drive system 220 may be driven by a separate belt coupled to a fixed or rotating ring to provide for control over dispense rate independent of the rate of relative rotation.

In addition, wrapping apparatus 200 may include sensors on one or more of downstream dispensing roller 216, idle roller 224 and idle roller 226, and an angle sensor may be provided for determining an angular relationship between load 210 and packaging material dispenser 206 about a center of rotation 254 (through which projects an axis of rotation that is perpendicular to the view illustrated in FIG. 1), and in some embodiments, one or both of a load distance sensor and a film angle sensor may also be provided. An angle sensor may be positioned proximate center of rotation 254, or alternatively, may be positioned at other locations, such as proximate rotating ring 204. Wrapping apparatus 200 may also include additional components used in connection with other aspects of a wrapping operation, e.g., a clamping device 259 may be used to grip the leading end of packaging material 208 between cycles, and/or a top sheet dispenser (not shown) may be used to dispense a sheet of packaging material onto the top of a load.

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where pre-stretching is used, the packaging material is stretched prior to being conveyed to the load. The dispense rate of the packaging material is controlled during the relative rotation between the load and the packaging material, and a lift assembly controls the position, e.g., the height, of the web of packaging material engaging the load so that the packaging material is wrapped in a spiral manner around the load from the base or bottom of the load to the top. Multiple layers of packaging material may be wrapped around the load over multiple passes to increase overall containment force, and once the desired amount of packaging material is dispensed, the packaging material is severed to complete the wrap.

Figure 2:
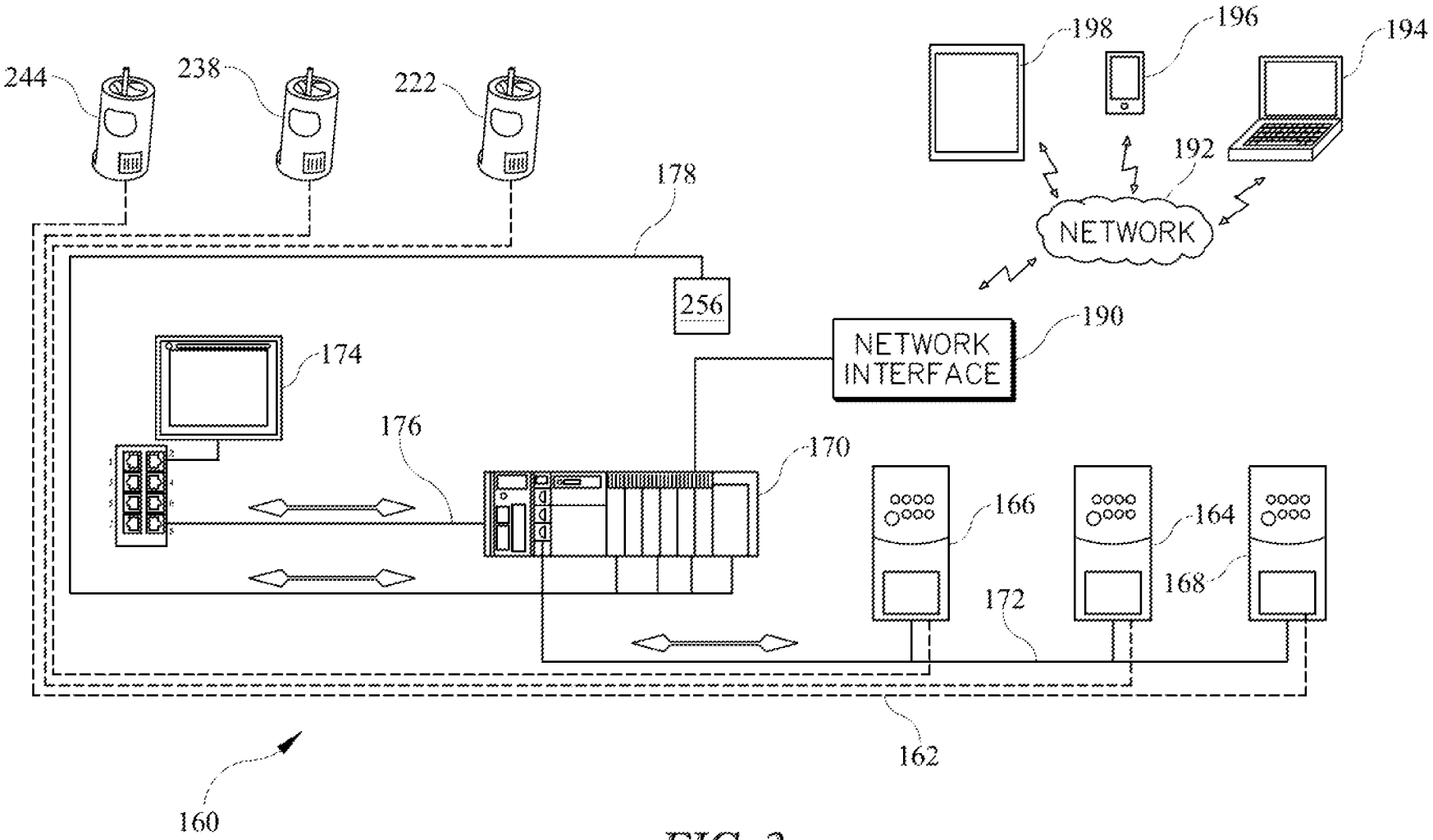
FIG. 2 is a schematic view of an example control system for use in the apparatus of FIG. 1.

An example schematic of a control system 160 for wrapping apparatus 200 is shown in FIG. 2. Motor 222 of packaging material drive system 220, motor 238 of rotational drive system 236, and motor 244 of lift drive system 242 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with a controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors (collectively represented at 256) through a data link 178, thus allowing controller 170 to receive performance related data during wrapping. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to wrapping apparatus 200.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others.

Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 200 is assumed to be incorporated wholly within components that are local to wrapping apparatus 200 illustrated in FIGS. 1-2. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. As such, the invention is not limited to the particular allocation of functionality described herein.

Those skilled in the art will recognize that the exemplary environments illustrated in FIGS. 1-2 are not intended to limit the present invention. Indeed, those skilled in the art will recognize that other alternative environments may be used without departing from the scope of the invention. For example, it will be appreciated that aspects of the invention may be used in other stretch wrapping machines, including rotating arm-based wrapping machines and turntable-based wrapping machines. Therefore, the invention is not limited to use in a rotating ring-based wrapping machine.

Automatic Roll Change System

In some embodiments of the invention, a stretch wrapping machine such as the rotating ring-type machine 200 of FIGS. 1-2, or alternatively, a rotating arm-based wrapping machine or a turntable-based wrapping machine, may include an automatic roll change system incorporating one or both of a packaging material guide assembly with pivotable support members and multiple mechanically-actuated load stations actuated by a common actuator assembly capable of actuating any of load stations when so positioned in a loading position.

In particular, in some embodiments of the invention, an automatic roll change system incorporating pivotable support members may include a packaging material roll support configured to support a replacement roll of packaging material for loading onto a packaging material roll carrier of a packaging material dispenser during a roll change operation, and a packaging material guide assembly defining at least one receptacle for receiving a plurality of rollers of the packaging material during at least a portion of the roll change operation, and including first and second support members disposed on opposite sides of the at least one receptacle, each of the first and second support members including at least one guide member configured to engage a portion of a leading end of a web of packaging material from the replacement roll of packaging material when the replacement roll of packaging material is supported on the packaging material roll support, and a release mechanism coupled to the first and second support members to move the first and second support members from a supporting position to a release position. The first and second support members in the supporting position are positioned to support the leading end of the web in a tortuous path corresponding to a winding of packaging material through the plurality of rollers, and in the release position are positioned to disengage the at least one guide member thereof from the leading end of the web. The release mechanism is configured to move each of the first and second support members between the supporting and release positions at least partially through movement about respective first and second axes.

In addition, in some embodiments of the invention, an automatic roll change system incorporating multiple mechanically-actuated load stations actuated by a common actuator assembly may include a plurality of load stations, each including a packaging material roll support configured to support a replacement roll of packaging material for loading onto the packaging material roll carrier during a roll change operation, and a packaging material guide assembly defining at least one receptacle for receiving a plurality of rollers of the packaging material dispenser during at least a portion of the roll change operation. The packaging material guide assembly may be configured to support a leading end of a web of packaging material from the replacement roll of packaging material in a tortuous path corresponding to a winding of packaging material through the plurality of rollers, and the packaging material guide assembly may include a mechanically-actuated release mechanism configured to disengage the packaging material guide assembly from the leading end of the web and thereby release the leading end of the web onto the plurality of rollers when the plurality of rollers are positioned within the at least one receptacle. The automatic roll change system may also include a positioning mechanism coupled to the plurality of load stations and configured to selectively position each of the plurality of load stations in a loading position, as well as an actuator assembly including at least one mechanical actuator disposed in a fixed position relative to the loading position to actuate the mechanically-actuated release mechanism of any of the plurality of load stations when so positioned in the loading position.

Figure 3:
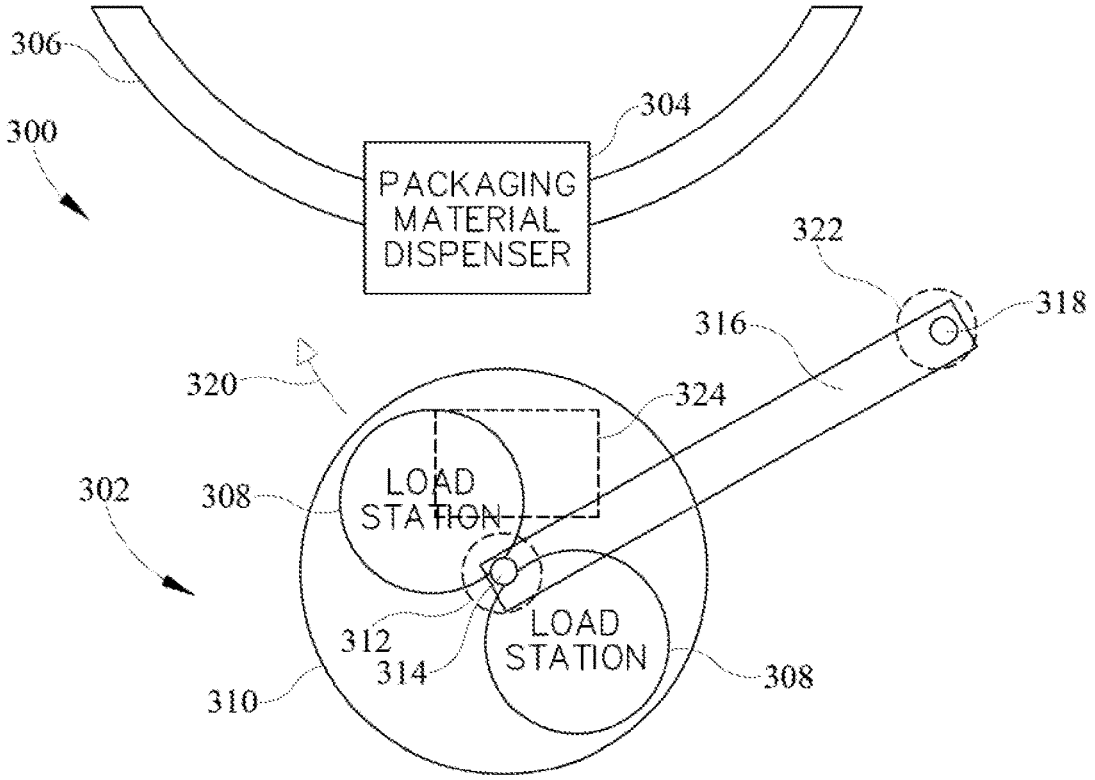
FIG. 3 is a functional top view of a rotating ring-type wrapping apparatus including an automatic roll change system consistent with the invention.

FIG. 3, for example, illustrates a wrapping apparatus 300 including an automatic roll change system 302 consistent with some embodiments of the invention. In this embodiment, wrapping apparatus 300 is a rotating ring-type wrapping machine, and as such, includes a packaging material dispenser 304 mounted on a rotating ring 306 configured for relative rotation about a load.

Automatic roll change system 302 may include a plurality of load stations 308 positioned at different angular positions on a carousel 310. Carousel 310 may be rotated about an axis 312, for example, by a pneumatic, hydraulic or electric drive 314 functioning in part as a positioning mechanism. In addition, carousel 310 may be mounted upon a support arm 316 that pivots about an axis 318 to move along an arcuate path 320, e.g., by a pneumatic, hydraulic or electric drive 322 also functioning in part as a positioning mechanism. Movement of support arm 316 in connection with rotation of carousel 310 may position one of load stations 308 in an appropriate position proximate to packaging material dispenser 304 to facilitate automated loading of a roll of packaging material onto a packaging material roll carrier of packaging material dispenser 304 and threading of a web of packaging material through a plurality of rollers in packaging material dispenser 304.

As will become more apparent below, each load station 308 may be mechanically-actuated, e.g., by a common actuator assembly 324 including one or more mechanical actuators capable of actuating any of the load stations 308 when positioned at an appropriate loading position of the carousel. In particular, each load station may have a predetermined angular position on the carousel such that when the carousel is rotated to that predetermined angular position, one or more mechanically-actuated mechanisms of the load station are aligned with corresponding mechanical actuators of actuator assembly 324, thereby enabling those mechanisms to be actuated by the actuator assembly. By doing so, a single set of one or more drives may be used to actuate multiple load stations, and furthermore, the moveable portion of the carousel may be devoid of any source of pneumatic, hydraulic or electrical power or energy. In this regard, a pneumatic, hydraulic or electrical drive may be considered to include any number of pneumatically, hydraulically or electrically driven devices for generating linear or rotary motion, including, for example, motors, cylinders, linear actuators, rotary actuators, etc., which in some instances may also be coupled to various mechanical linkages.

Movement of support arm 316 may be used to swing the carousel between a first operative position where the carousel may be rotated to position one of the load stations directly underneath packaging material dispenser 304 and a second preloading position where the carousel is distal from the wrapping apparatus to permit an operator to preload rolls of packaging material and/or remove used rolls.

Of note, while FIG. 3 illustrates an implementation where load stations are disposed on a rotatable carousel that itself moves along an arcuate path on support arm 316, the invention is not so limited. Load stations may, in other embodiments, be positionable through various combinations of linear and/or rotary movement. For example, load stations may be positionable to a loading position through purely linear movement, and furthermore, the load stations as well as the common actuator assembly (and thus the loading position) may further be movable through additional linear and/or rotary movement. Further, it will be appreciated that more than two load stations may be supported in other embodiments.

Figure 4:
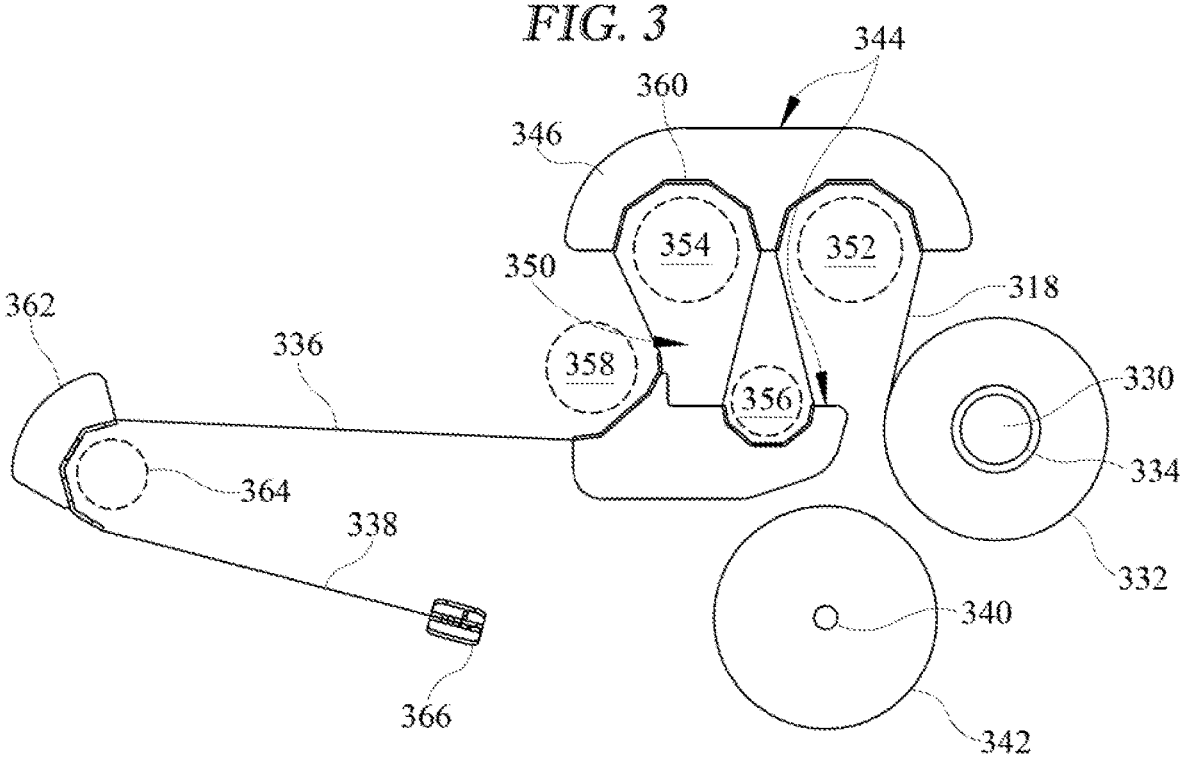
FIG. 4 is a top view of an example implementation of a load station from the automatic roll change system of FIG. 3.

FIG. 4 illustrates a top plan view of one example implementation of a load station 308 consistent with some embodiments of the invention. Load station 308 may include a packaging material roll support 330 shown supporting a roll 332 of packaging material. Also illustrated is a spool 334 of roll 332, about which is wound a web 336 of packaging material having a leading end 338. Load station 308 may also include a second packaging material roll support 340, e.g., in the form of a peg or spike, and upon which a used roll 342 of packaging material may be released by the packaging material dispenser during a roll change operation. In some embodiments, for example, roll supports 330, 340 may be disposed at different angular positions but at the same radial distance on the carousel such that during a roll change operation, the carousel may be rotated to a position underneath a roll carrier of the packaging material dispenser that aligns with roll support 340 to enable a used roll (which may be empty or only partially used) to be dropped onto the roll support. Thereafter, a further rotation of the carousel may occur to position roll support 330 underneath the roll carrier to enable the roll carrier to pick up the new or replacement roll 332.

Load station 308 also includes a packaging material guide assembly 344 including a pair of support members 346, 348 that define one or more receptacles 350 therebetween. Received within the one or more receptacles 350 during a roll change operation are one or more rollers of the packaging material dispenser, e.g., pre-stretch rollers 352, 354 and idle rollers 356, 358. As will become more apparent below, support members 346, 348 may be moved between supporting and release positions at least partially through rotary motion, and in this regard, these support members may in some embodiments be referred to as drop away shoes.

Each support member may include one or more guide members 360 that serve to guide web 336 in a tortuous path that corresponds to the winding of the web through the rollers of the packaging material dispenser. In some embodiments, each guide member 360 may at least partially circumscribe arcuate edges of a base plate of each support member such that the guide member effectively circumscribes a corresponding roller of the packaging material dispenser. Each guide member, for example, may project generally transverse to the base plate of the support member to engage the web of packaging material in a spaced-apart relationship from the rollers.

It will be appreciated that more than two support members may be used in some embodiments, and moreover, that pivotable or otherwise movable support members may only be used for a subset of the rollers in a packaging material dispenser. As such, one or more fixed guide members such as guide member 362 may be used for other rollers such as roller 364. Furthermore, it may be desirable to additionally include a clamp 366 to retain the leading end 338 of web 336, with a cooperating clamp on the packaging material dispenser (not shown) configured to grab the leading end of the web during a roll change operation.

Preloading of a load station may be performed manually by an operator. In some embodiments, for example, an operator may place roll 332 on roll support 330 and then unwind a length of packaging material sufficient to be wound around each guide member 360, 362 and engage with clamp 366. The operator may then gather the web into a rope and manually wind the roped web around each guide member and then secure the leading end onto clamp 366. At this time, the load station is distal from the packaging material dispenser, so no rollers are positioned within the one or more receptacles 350. Then, during the roll change operation, the load station is aligned with the packaging material dispenser and the packaging material dispenser is lowered onto the load station to enable the packaging material roll carrier to pick up roll 332 and to project the rollers 352-358 into the receptacle and interposed into the tortuous path of the web.

Figure 5:
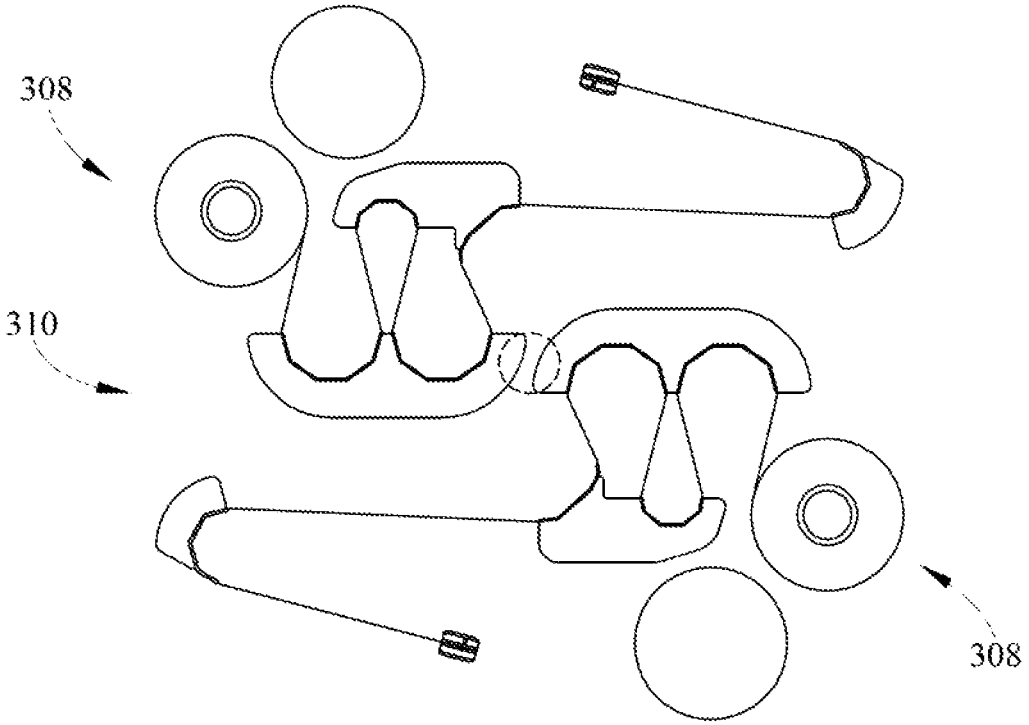
FIG. 5 is a top view of an example two load station carousel implementation of the automatic roll change system of FIG. 3.
Figure 6:
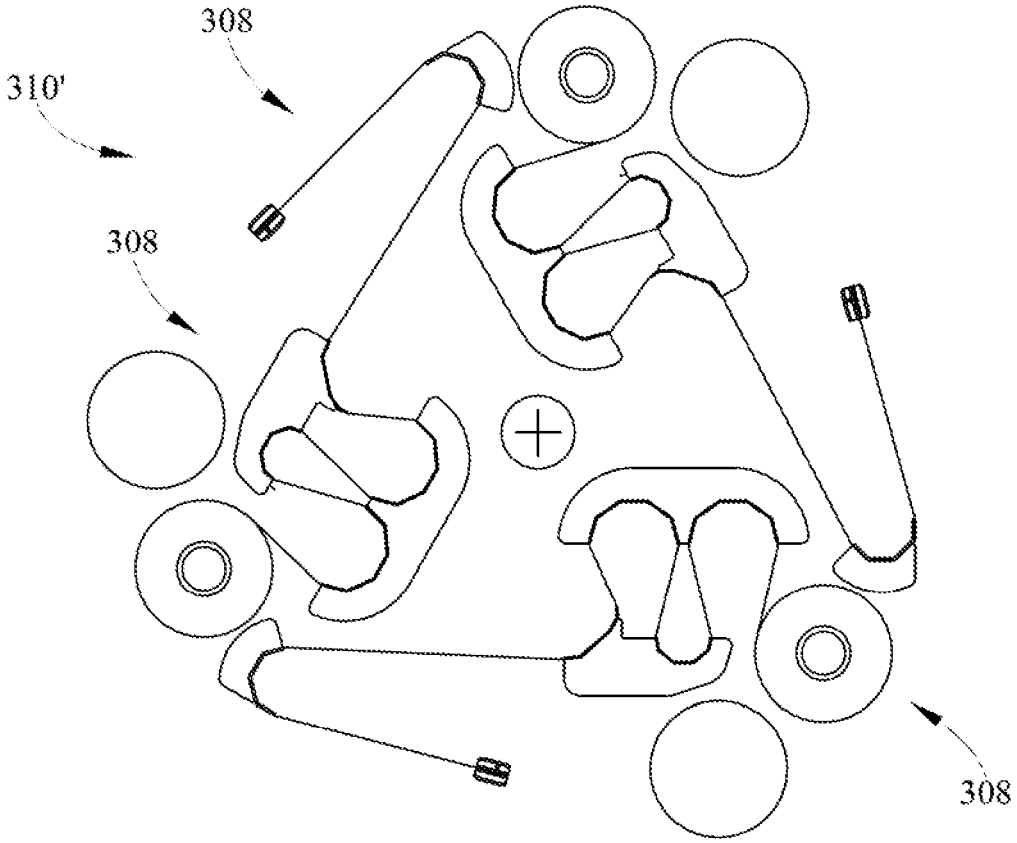
FIG. 6 is a top view of an example three load station carousel implementation of the automatic roll change system of FIG. 3.

As noted above, multiple load stations may be provided at different angular positions on a carousel in different embodiments. FIG. 5, for example, illustrates carousel 310 of FIG. 3 having two load stations 308 disposed opposite one another and separated by 180 degrees of angular position. FIG. 6, in contrast, illustrates an alternate carousel 310' having three load stations 308 angularly separated from one another by 120 degree increments. Additional load stations (e.g., four or more) may also be provided on a carousel in other embodiments, and multiple carousels may also be used in some embodiments.

Figure 7A:
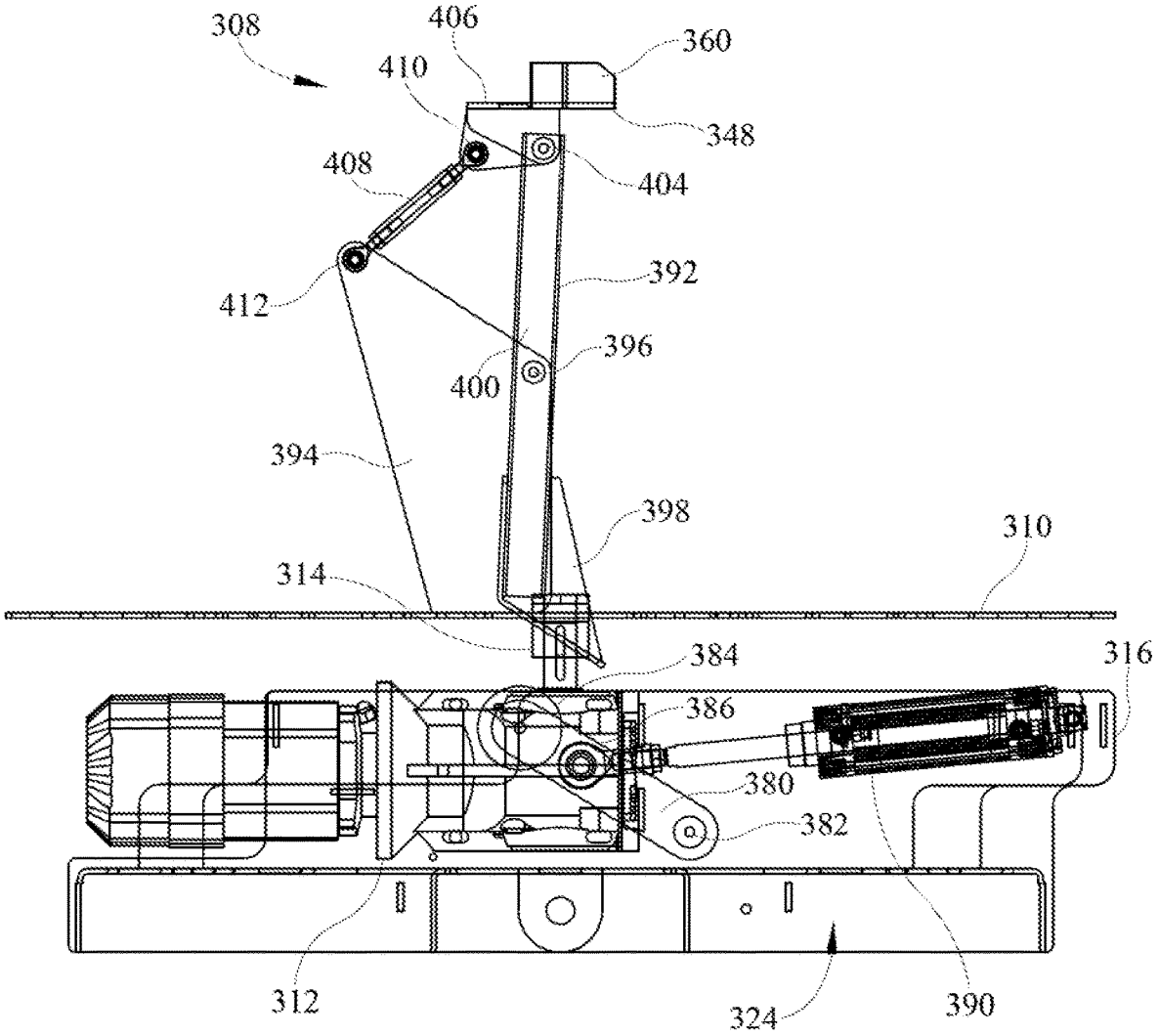
FIGS. 7A and 7B are functional side views of an example implementation of the load station of FIG. 4, with FIG. 7A showing a supporting position and FIG. 7B showing a release position.
Figure 7B:
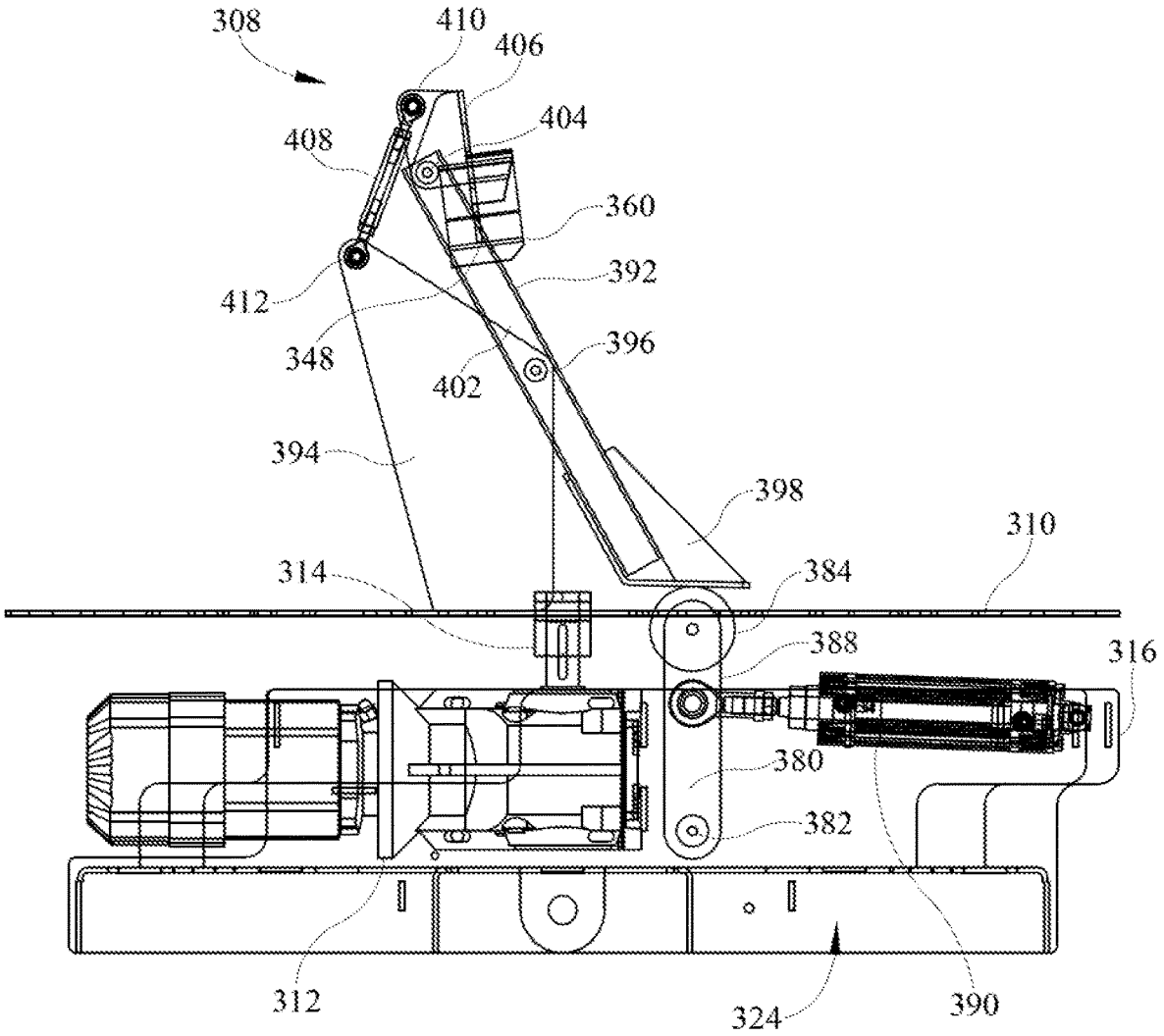

Now turning to FIGS. 7A-7B, these figures illustrate a partial side cross-sectional view of a portion of automatic roll change system 302 of FIG. 3, illustrating carousel 310 supported on support arm 316 and rotated about axis 314 by a positioning mechanism 312, e.g., an electric motor. In addition, in this embodiment, common actuator assembly 324 includes a mechanical paddle actuator implemented as an arm 380 configured for rotation about an axis 382 and including a roller 384. Arm 380 is movable between a retracted position 386 (FIG. 7A) and an extended position 388 (FIG. 7B), and is driven by the linear movement of a linear actuator 390 such as a pneumatic cylinder. Of note, in the retracted position 386, arm 380 is below the elevation of carousel 310, but in the extended position 388, arm 380 may project upwardly above the elevation of carousel 310 in some embodiments, so in such embodiments, one or more apertures may be present in carousel 310 to permit arm 380 to project through the carousel surface.

In addition, FIGS. 7A-7B illustrate an implementation of support member 348 of load station 308, including guide 360, and supported by a lever 392 that is supported by a base assembly 394 to rotate about an axis 396, and that includes at an opposite end from support member 348 a paddle 398 that selectively engages with roller 384 of actuator assembly 324 to move support member 348 between a supporting position 400 (FIG. 7A) and a release position 402 (FIG. 7B). Lever 392 is normally biased, e.g., via a spring, to supporting position 400, and actuation of actuator assembly 324 rotates arm 380 to the extended position 388 to engage roller 384 with paddle 398 and rotate lever 392 about axis 396 to transition support member 348 to release position 402.

In the illustrated embodiment, support member 348 is rotatably coupled to lever 392 to additionally rotate about an axis 404, e.g., using an axle coupled through a flange 406 formed on the support member. In addition, a mechanical linkage such as an arm 408 is coupled between support member 348 and base assembly 394, with pivoting connections between arm 408 and each of support member 348 and base assembly 394 to provide rotation about axes 410, 412. Axis 410 is radially offset from axis 404 on flange 406, and as a result of the fixed length of arm 408, pivoting of lever 392 about axis 496 also causes support member 348 to pivot about axis 404 relative to lever 392 and effectively "drop away" from the rollers of the packaging material dispenser during a roll change operation to disengage from the web of packaging material, as is illustrated in FIG. 7B. As a result, the guide members in the illustrated embodiment pivot about multiple axes to both separate from and drop away from the rollers of the packaging material dispenser.

Figure 8:
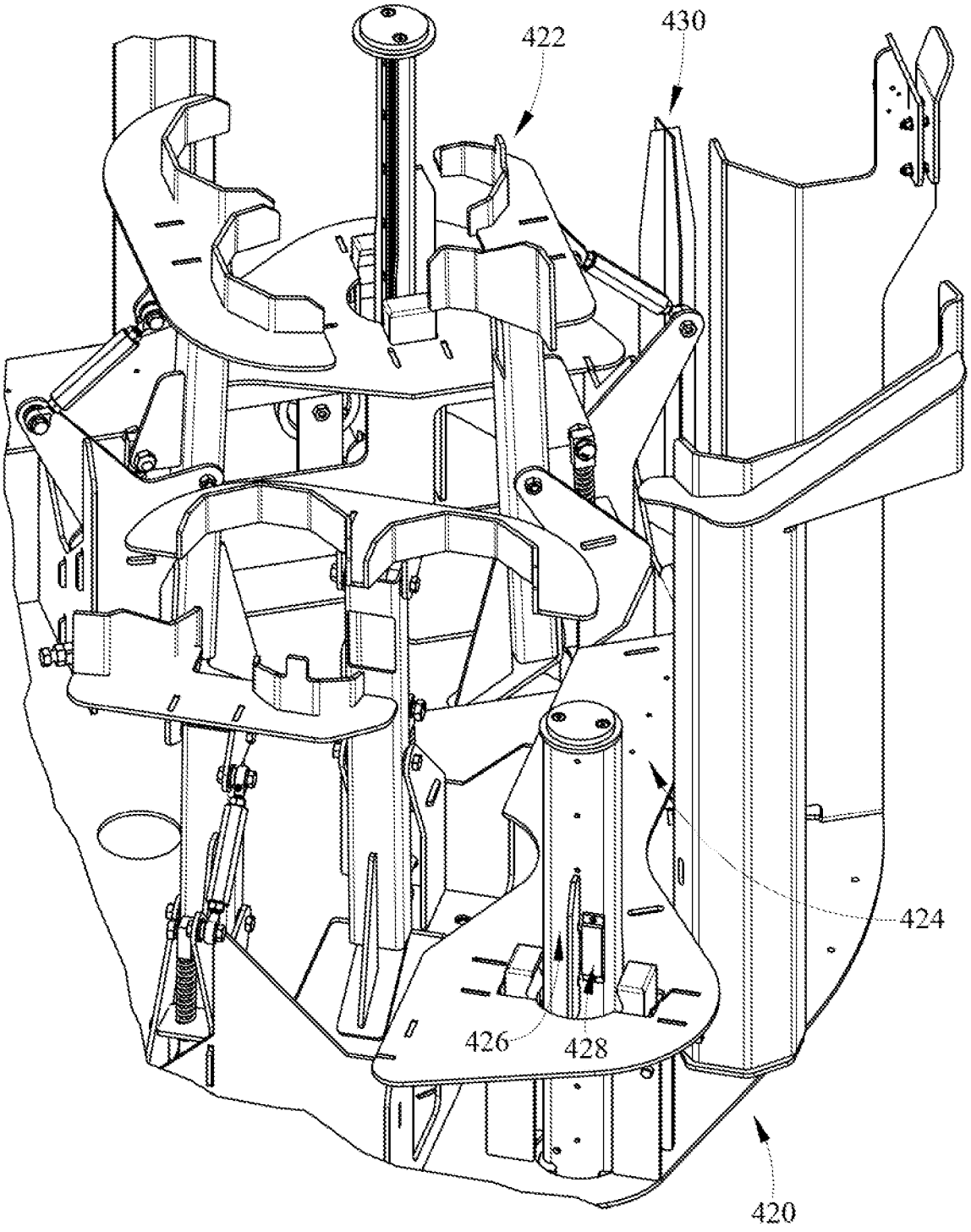
FIG. 8 is a perspective view of an example implementation of the two load station carousel of FIG. 5.

It will be appreciated that support member 346 may also be configured in a similar manner, with either the same mechanical actuator and/or release mechanism, or a different mechanical actuator and/or release mechanism, used to actuate support member 346 in the same manner as support member 348. FIG. 8, for example, illustrates an example implementation of an automatic roll change system 420 having two load stations 422, 424, with the support members of load station 422 shown in a supporting position and the support members of load station 424 shown in a release position.

Each load station may also include additional mechanically-actuated mechanisms in some embodiments. For example, as shown in FIG. 8, load station 424 includes a retractable roll support 426 configured as a retractable support peg that is movable linearly along an axis, e.g., a vertical axis, to receive the spool of a roll of packaging material. Support 426 may be biased to an upward position and may be retracted in response to contact with the support shaft of the packaging material roll carrier as the packaging material dispenser is lowered. While in some embodiments an actuator may move support 426, in other embodiments a spring or pressure bias may be used such that the support returns to an elevated position in the absence of a downward force applied thereto.

In addition, in some embodiments, a peripheral support mechanism 428, configured in the illustrated embodiment as a pair of retractable fingers, may be used to support a roll of packaging material in a somewhat raised elevation from the plane of the carousel, and above the retracted position of roll release 426. Raising the roll of packaging material to a higher elevation may permit, for example, a support shaft of a packaging material roll carrier to be inserted fully through a roll of packaging material such that one or more retractable support members, e.g., fingers or tabs disposed proximate an end of the support shaft, may be positioned below the spool of a roll when extended. Then, when the peripheral support mechanism 428 is retracted, the roll of packaging material may drop down onto the retractable support members of the support shaft and thereby be supported thereby. In some embodiments, the peripheral support mechanism may be actuated in response to downward movement of support 426 such that once the support shaft of the packaging material roll carrier has reached a predetermined elevation, the peripheral support mechanism is automatically released. Other manners of releasing and/or resetting the peripheral support mechanism may be used in other embodiments.

In addition, as noted above, a second roll support may be provided in each load station to support a used or empty roll during a roll change operation. As shown in FIG. 8, in some embodiments such a support may be configured as a spike or shaft 430.

It will be appreciated that various alternate mechanical linkages, mechanical actuators, mechanically-actuated mechanisms and the like may be provided for each load station in other embodiments, so the invention is not limited to the particular mechanical arrangements disclosed herein.

One-Way Clutch Arrangement

In some embodiments of the invention, a stretch wrapping machine such as the rotating horizontal ring-type machine 200 of FIGS. 1-2 may include a one-way clutch arrangement suitable for use in rewinding a roll of packaging material. In some embodiments, for example, a one-way clutch arrangement may be usable in combination with an automatic roll change system to facilitate the rewinding of packaging material back onto a used or empty roll prior to an automatic roll change operation. In other embodiments, however, a one-way clutch arrangement may be used on a wrapping machine without any automatic roll change functionality.

In various embodiments, as noted above, rewind of a packaging material web may be desirable in order to rewind unwound material back onto a packaging material roll in connection with a roll change operation. It will be appreciated that after a wrapping operation is complete, a web of packaging material still generally extends through the roller arrangement of the packaging material dispenser so that the leading end of the web is ready to be applied in the next wrapping operation. Thus, before a used roll can be removed from the packaging material dispenser, the unwound packaging material web is desirably wound back onto the packaging material roll.

On the other hand, many packaging material dispensers include pre-stretch arrangements where a downstream pre-stretch roller is configured to rotate with a faster surface speed than an upstream pre-stretch roller to stretch the packaging material by a controlled amount prior to the packaging material being applied to the load, generally through the use of belt and pulley or gear arrangements that provide a fixed ratio between the relative rotation speeds of the pre-stretch rollers. With a fixed ratio established between the pre-stretch rollers, however, reversing the rotation of the pre-stretch rollers in order to rewind packaging material back onto a roll still results in the downstream pre-stretch roller having a faster surface speed than the upstream pre-stretch roller, which instead of stretching the packaging material causes the packaging material to be fed to the upstream pre-stretch roller at a faster rate than the upstream pre-stretch roller can consume, creating slack and the bunching of packaging material between the pre-stretch rollers, which may lead to backlash or binding of packaging material between the pre-stretch rollers. It is therefore desirable in a rewind operation for the surface speed of the upstream pre-stretch roller to be substantially equal to or greater than that of the downstream pre-stretch roller.

Other instances where rewind of the packaging material onto a packaging material roll may be desirable may be after a packaging material web tear or, in the alternative, at the initial startup of stretch wrapping operation when new packaging material is already fed through the pre-stretch assembly but is not yet tensioned (i.e., some degree of slack is present in the web). More particularly, during initial start of stretch wrapping and before actual pre-stretch of a web, the web may be loosely threaded through the pre-stretch assembly of the packaging material dispenser, and prior to high-speed wrapping operations, appropriate removal of slack in the web throughout the pre-stretch assembly may be desirable so that the functional stretching of the packaging material can occur prior to dispensing. Further, during a packaging material roll change, the web of packaging material may be only loosely wound through the pre-stretch assembly and the upstream and downstream pre-stretch rollers, and thus it may be desirable for the pre-stretch assembly, at installation of the new roll of web material, to remove the slack by rewinding the packaging material back through the pre-stretch assembly and onto the roll.

In order to facilitate such rewind operations, some embodiments consistent with the invention may implement a one-way clutch arrangement that alters the relative surface speeds of the upstream and downstream pre-stretch rollers in a reverse direction. FIGS. 9-12, for example, illustrate an example embodiment of a pre-stretch assembly 500 for use in packaging material dispenser, e.g., packaging material dispenser 206 of FIG. 1.

Figure 12:
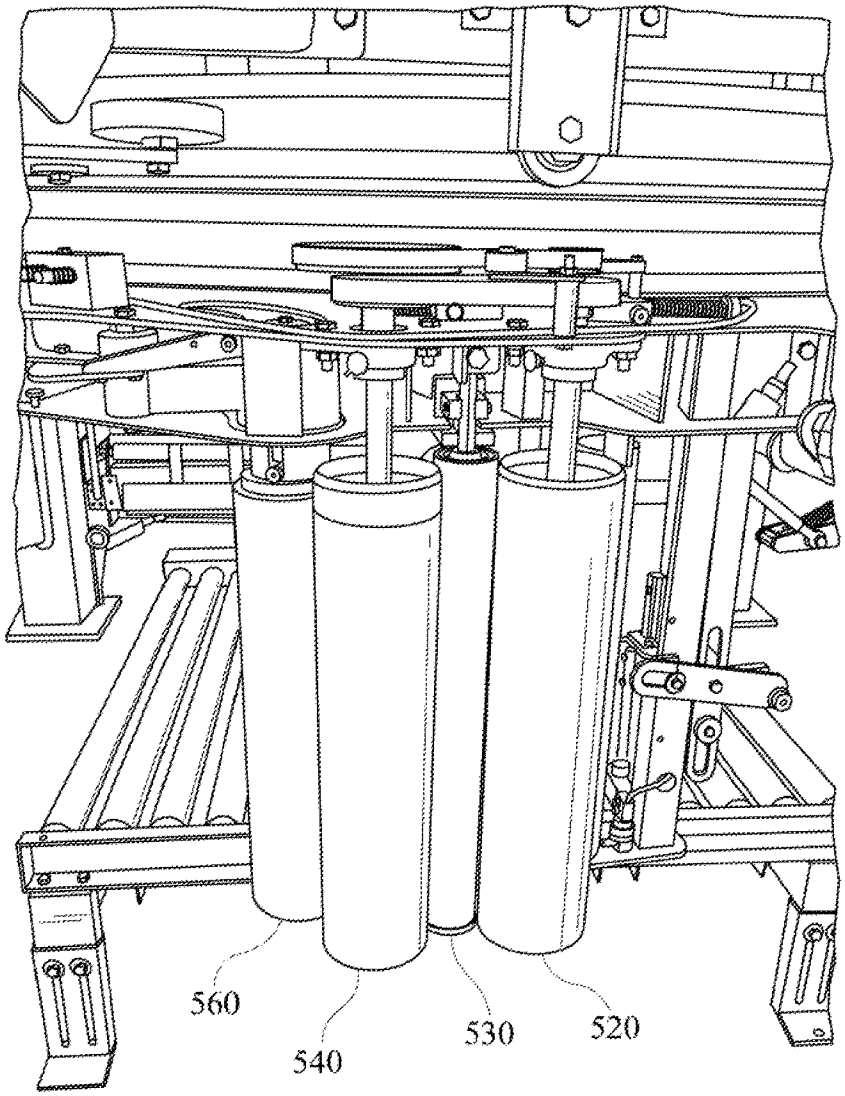

Generally, pre-stretch assembly 500 allows a packaging material web 502 to be wound therethrough and stretched at a predefined rate so that stretched material is dispensed. As shown in FIG. 12, the pre-stretch assembly 500, in some embodiments, may include a close arrangement of a packaging material roll 560 to directly contact an upstream pre-stretch roller 540 of the pre-stretch assembly so that rotation of the upstream pre-stretch roller 540 drives rotation of the packaging material roll 560, although in other embodiments, the packaging material roll 560 may be separated from upstream pre-stretch roller 540 and/or may be driven by another roller or other drive mechanism.

A downstream pre-stretch roller 520 is provided downstream of both the packaging material roll 560 and the upstream pre-stretch roller 540 and in some variations an idle roller 530 may be included to tension the web between the upstream pre-stretch roller and downstream pre-stretch roller. One or both of the downstream pre-stretch roller and upstream pre-stretch roller may be operably rotated or driven by a drive motor to pull the web of material through the pre-stretch assembly 500 to be pre-stretched at a defined stretch ratio and then delivered for dispensing.

Returning to FIG. 9, upstream pre-stretch roller 540 has both a pre-stretch pulley 542 and rewind pulley 544, both of which may rotate with the upstream pre-stretch roller 540 depending on the rotation direction. A shaft 549 extends upward from the upstream pre-stretch roller and through both pre-stretch pulley 542 and rewind pulley 544 and is operably attached thereto for driving rotation in one direction but slipping in a second direction. A similar construction may be implemented for the downstream pre-stretch roller 520, which may incorporate a pre-stretch pulley 522 and a rewind pulley 524 as part of the driving mechanism. Shaft 529 may extend upward from the downstream pre-stretch roller 520 and be operably attached to the pre-stretch and rewind pulleys 522, 524, similar to the upstream pre-stretch roller configuration but instead keyed for driving rotation in both rotational directions.

A drive belt 510 may extend from a drive motor or other drive mechanism into the pre-stretch assembly 500, as depicted in the embodiment shown. Alternative embodiments for driving the upstream and downstream pre-stretch rollers, as previously defined, may be implemented and may further include separate drive assemblies for the packaging material roll and/or the relative rotation between the dispenser and the load. Pre-stretch rollers 520, 540 may be driven in some embodiments by the ring that is used to impart relative rotation between the packaging material dispenser and the load, while in other embodiments, the pre-stretch rollers may be driven by a separate ring, by a hydrostatic drive, by a separate motor in the packaging material dispenser, or in other manners that will be apparent to those of ordinary skill having the benefit of the instant disclosure.

Drive belt 510, as shown in one embodiment, extends around the horizontal ring and into the pre-stretch assembly 500 to impart rotational power to the pre-stretch rollers. The drive belt 510 extends around both the rewind pulley 544 for the upstream pre-stretch roller and the rewind pulley 524 for the downstream pre-stretch roller so that upon rotation of the ring by the drive motor, drive belt 510 rotates both rewind pulleys 524, 544 in both the forward/dispensing and reverse/rewind directions.

In addition to the rewind pulleys, a pre-stretch pulley may be provided in some embodiments for both the upstream pre-stretch roller and the downstream pre-stretch roller. Pre-stretch pulley 542 for the upstream pre-stretch roller is stacked above the rewind pulley and is operably connected to the pre-stretch pulley 522 of the downstream pre-stretch roller. In some embodiments, the pre-stretch pulley 542 of the upstream pre-stretch roller and the pre-stretch pulley 522 of the downstream pre-stretch roller are operably connected by a braking belt 514. As a result of such operable connection by the braking belt, rotation of the downstream pre-stretch pulley 522 will cause rotation of the upstream pre-stretch pulley 542.

In some embodiments, the pre-stretch pulley 542 of the upstream pre-stretch roller has a larger diameter than the diameter of the pre-stretch pulley 522 of the downstream pre-stretch roller. The variation in diameter size between the upstream pre-stretch pulley and the downstream pre-stretch pulley imparts a faster surface speed to the surface of the downstream pre-stretch roller 520 than that of the upstream pre-stretch roller, and thus imparts a determined pre-stretch on the web of packaging material as it extends through the pre-stretch assembly 500 and is delivered for dispensing. As disclosed further herein, pre-stretch of the packaging material web is caused by resistance to rotation or braking of the upstream pre-stretch roller as the downstream pre-stretch roller pulls the packaging material web 502 through the pre-stretch assembly 500 and around the upstream pre-stretch roller from the packaging material roll 560. As noted, when rotating in the forward dispensing or unwinding direction, a one-way clutch interposed between both the pre-stretch and rewind pulley of the upstream pre-stretch roller slips and is not locked to rotation of the shaft 549 and thus inhibits rotation by virtue of the diameter difference between pre-stretch pulleys 542 and 522.

In some embodiments, the rewind pulley 544 for the upstream pre-stretch roller is substantially similar to the diameter of the rewind pulley 524 of the downstream pre-stretch roller in order to maintain a similar rotation rate in the reverse direction of both the upstream pre-stretch roller and the downstream pre-stretch roller when rewind operations are undertaken. It will be appreciated, however, that the relative diameters of pulleys 522 and 542, and of pulleys 524 and 544, may vary in different embodiments. For example, in the embodiment illustrated in FIGS. 9-12, it is assumed that the diameters of the pre-stretch rollers 520, 540 are substantially similar, such that control over the relative surface speeds of the surfaces of rollers 520, 540 is primarily imparted by the diameters of the various pulleys. In other embodiments, however, pre-stretch rollers 520, 540 may have different diameters, and as such, the relative diameters of pulleys 522, 542 and of pulleys 524, 544 may differ in order to provide desired roller surface speeds in both the pre-stretch and rewind directions.

It will also be appreciated that while the herein-described embodiments utilize pulleys and belts to drive the pre-stretch rollers, in other embodiments, alternative drives and/or rate control devices may be used. In some embodiments, for example, different combinations of toothed or smooth pulleys and toothed or smooth belts may be used, while in other embodiments, gears may be used in lieu of or in combination with a belt/pulley arrangement. Other manners of controlling the relative surface speeds of the pre-stretch rollers may be used in other embodiments, and will be appreciated by those of ordinary skill having the benefit of the instant disclosure.

In the illustrated embodiment, in order to provide the desired locking or slipping of pulleys relative to the pre-stretch rollers, one-way clutch arrangements may be used. For example, one or more one-way clutches may be interposed in between the pre-stretch roller shaft 549 and both the rewind pulley 544 and the pre-stretch pulley 542 of the upstream pre-stretch roller. Thus, in some embodiments, a rewind pulley one-way clutch 548 may be provided and interposed between the rewind pulley 544 and shaft 549, and a pre-stretch pulley one-way clutch 546 may be interposed in between pre-stretch pulley 542 and the shaft 549. Other structure may be utilized in variations to allow for a slip relationship to exist between both the pulleys and the upstream pre-stretch roller when rotating in the forward, dispensing, wrapping or unwinding direction (a counter-clockwise rotational direction from the perspective of FIG. 9).

In various embodiments, the one-way clutches slip in the forward or dispensing direction such as during counter-clockwise rotation of the upstream pre-stretch roller in the embodiment depicted. When unwinding or dispensing packaging material, e.g., film, to the load, the upstream pre-stretch roller is not driven at the downstream pre-stretch roller speed but acts to retard the dispensing rate and further act as a brake to the dispensing of the packaging material, thereby stretching the web as it passes through the assembly 500. Thus, the downstream pre-stretch roller rotates due to it being keyed or locked to rotation of the rewind pulley 524 which is connected to the drive belt 510. Downstream pre-stretch roller 520 pulls the packaging material web through the assembly from the packaging material roll 560 and around the upstream pre-stretch roller 540. The pulleys 542 and 544 are allowed to slip in such forward direction but are keyed or locked to the upstream pre-stretch roller shaft in the opposing direction. Thus, the roller acts to brake the passage of the packaging material web through the assembly as it is pulled by the downstream pre-stretch roller, driven by the drive belt, with the speed/passage of the packaging material braked by virtue of the combined ratio variance of the pre-stretch pulleys and the keyed relationship of the clutches to the upstream pre-stretch roller shaft for clockwise rotation.

Figure 9:
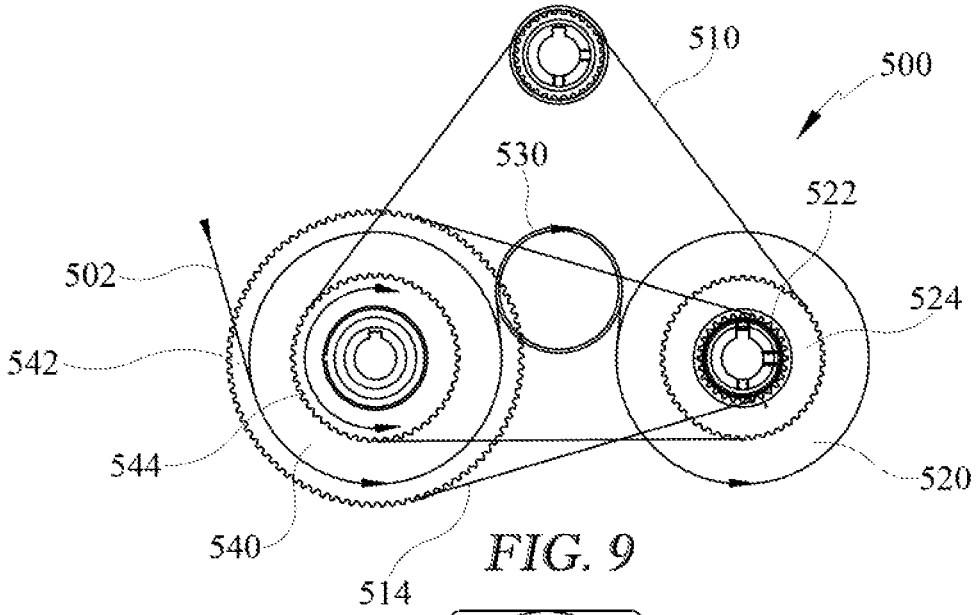
FIGS. 9 and 10 are functional top and side views of an example implementation of a packaging material dispenser including a one-way clutch arrangement consistent with the invention.
Figure 10:
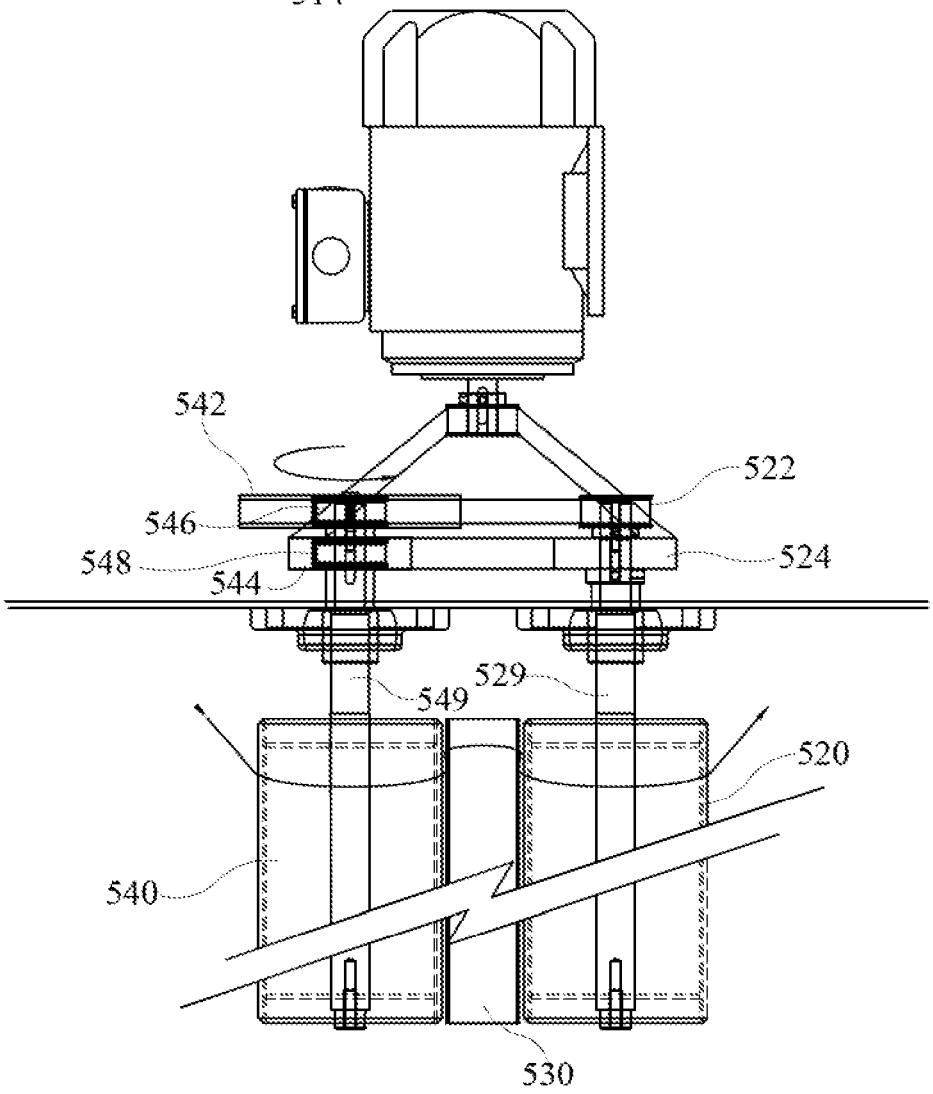
Figure 11:
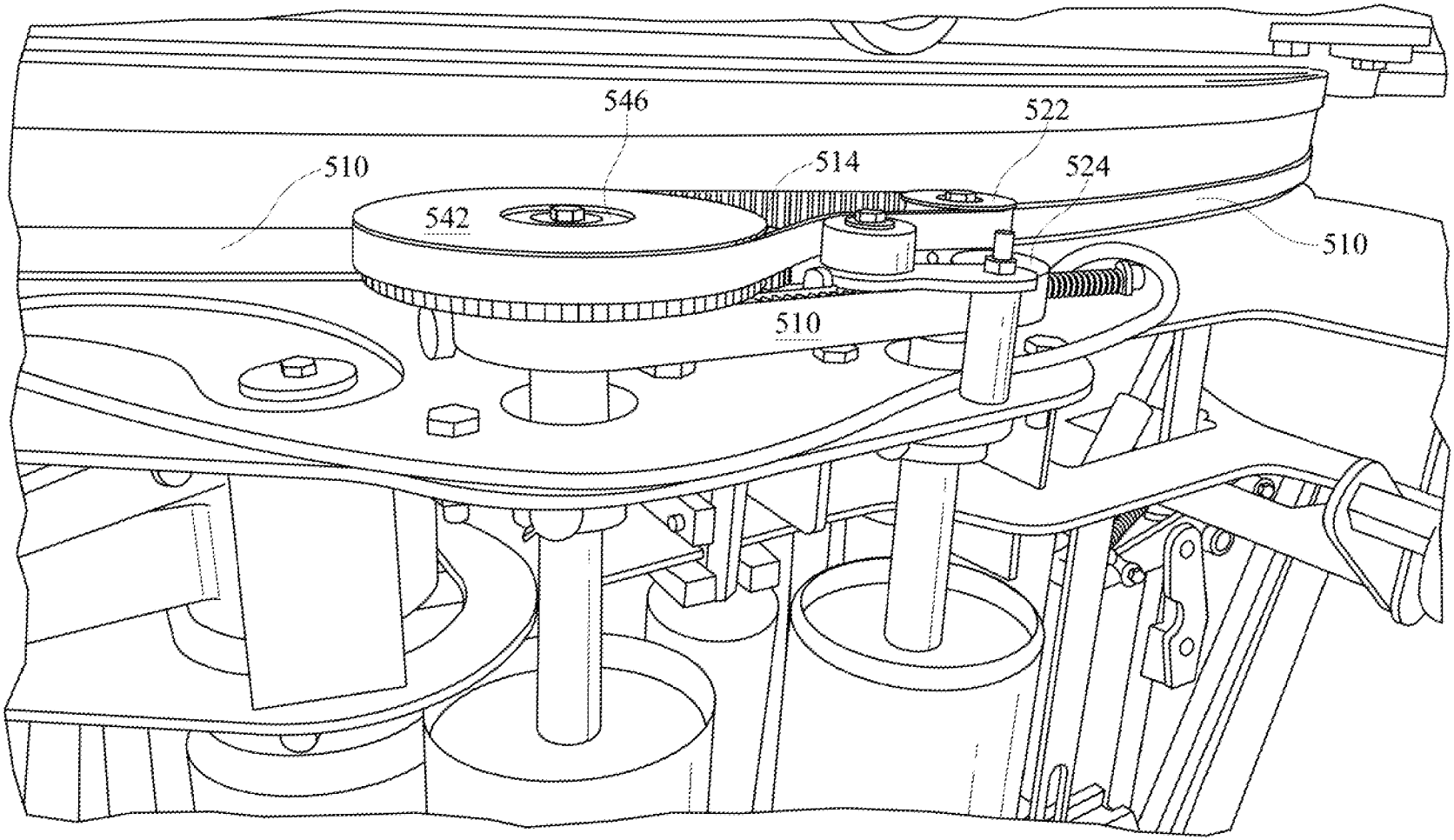
FIGS. 11 and 12 are perspective views of another example implementation of a packaging material dispenser including a one-way clutch arrangement consistent with the invention.

Thus, for the upstream pre-stretch roller 540, the pre-stretch pulley 542 and rewind pulley 544 are keyed or locked to the shaft 549 in the rewind direction (i.e., the clockwise rotational direction from the perspective of FIG. 9). As the downstream pre-stretch roller continues rotating to dispense material, the downstream pre-stretch roller pulls the packaging material past the upstream pre-stretch roller around which the packaging material is wrapped, the speed at which the packaging material is allowed around the upstream pre-stretch roller being limited by the braking restriction of the upstream pre-stretch roller one-way clutches and pre-stretch gear ratios.

For imparting actual pre-stretch on the packaging material web, both the pre-stretch pulley clutch 546 and the rewind pulley clutch slip in relation to the shaft 549. The downstream pre-stretch roller pulls the packaging material through the assembly while the surface of the upstream pre-stretch roller brakes the dispensing relative to the gear size ratio of the pre-stretch pulleys for the upstream and downstream pre-stretch roller. The web of packaging material 502 therefore pulls on the upstream pre-stretch roller surface while the upstream pre-stretch roller resists rotation hence imposing a predefined stretching action on the web 502 extending through the pre-stretch assembly 500.

In the embodiment depicted, both the pre-stretch pulley 542 and the rewind pulley 544 of the upstream pre-stretch roller incorporate one-way clutches 546, 548 in between both the pre-stretch pulley and the rewind pulley. As indicated, the clutches on the upstream pre-stretch roller allow the shaft to slip in the rewind direction and lock in the unwind direction of rotation. Other variations to impart such relationship between the upstream pulleys and roller may be utilized such as a combined pulley and clutch system integrating a single one-way clutch affixed to multiple pulleys.

In the embodiments depicted in the figures, the drive belt 510, when implementing a rewind operation on the pre-stretch assembly, rotates both the upstream pre-stretch roller and downstream pre-stretch roller at substantially equal 1:1 rotation ratio allowing the web of material threaded through the pre-stretch assembly to be rewound through the pre-stretch assembly and back towards the packaging material roll 560 without bunching or gathering. The substantially 1:1 rotational rates of the upstream pre-stretch roller and downstream pre-stretch roller are dictated by the sizes or diameters of the rewind pulleys 544 and 524 of both the upstream pre-stretch roller and the downstream pre-stretch roller. Slight variations may be imposed on the rotational rates as needed by modifying such diameters, and as noted above, diameter variations may also be based on differences in the diameters of the respective pre-stretch rollers such that a substantially 1:1 surface speed ratio is obtained for the pre-stretch rollers.

In some embodiments, the packaging material roll 560 may rotate directly in contact with the upstream pre-stretch roller 540 such that rotation of the upstream pre-stretch roller imposes an opposite rotation on the packaging material roll, thereby driving rotation of the packaging material roll 560. As well, and as is depicted within the embodiment of FIGS. 9-12, an idle roller 530 may be interposed in between both the upstream and downstream pre-stretch roller to apply appropriate tension to the web of material 502, and the idle roll, in some embodiments, may be tilted inwardly to apply appropriate tension to the web of material extending therebetween. Alternative embodiments may utilize other structures as a tensioning device including bars, frames or other known devices.

In other embodiments, packaging material roll 560 may be driven in alternate manners. For example, rather than driving the roll with pre-stretch roller 540, a different drive roller may be used to drive the roll. In one example embodiment, the drive roller may be located near the top of the roll (e.g., about 4 inches down from the top of the roll) and may be substantially shorter in length (e.g., about 2 inches in length). Furthermore, the drive roller may be driven proportionally to the surface speed of the upstream pre-stretch roller 540, e.g., at a slightly slower rate (e.g., about 5-6 percent slower). It has been found, for example, that some packaging material rolls will include diameter variations along the lengths thereof, such that driving a roll with a longer roller such as a pre-stretch roller may cause the roll to be driven at the high points along the length, and further cause packaging material located at lower points to creep. By utilizing a slower rotating, shorter length drive roller, therefore, such creeping is reduced.

Therefore, in some embodiments, the aforementioned one-way clutch arrangement enables both an upstream pre-stretch pulley and an upstream rewind pulley of an upstream pre-stretch roller to slip relative to the rotation of the upstream pre-stretch roller in an unwind direction of packaging material travel when dispensing packaging material to a load, while also locking both the upstream pre-stretch pulley and the upstream rewind pulley of the upstream pre-stretch roller relative to the rotation of the upstream pre-stretch roller in a rewind direction of packaging material travel to wind the packaging material around a packaging material dispenser roll.

Also, in some embodiments, the aforementioned one-way clutch arrangement may be considered to enable rotation of an upstream pre-stretch roller at a predetermined surface speed slower than that of a downstream pre-stretch roller during unwinding of a packaging material from a packaging material dispenser roll, and after reversing the rotation direction of the upstream pre-stretch roller and downstream pre-stretch roller, enable rotation of the upstream pre-stretch roller at a predetermined surface speed substantially equal to that of the downstream pre-stretch roller rate during winding of the packaging material onto the packaging material dispenser roll. Further, in some embodiments, the arrangement may be considered to operatively connect an upstream pre-stretch roller with a downstream pre-stretch roller in a packaging material unwind direction to rotate the downstream pre-stretch roller with at a higher surface speed than that of the upstream pre-stretch roller to pre-stretch the packaging material, and also operatively connect the upstream pre-stretch roller with the downstream pre-stretch roller in a packaging material rewind direction to rotate the upstream pre-stretch roller at a surface speed substantially equal to that of the downstream pre-stretch roller to rewind the packaging material on the packaging material dispenser roll.

Roll Change Operation

To perform a roll change operation in some embodiments of the invention, a controller of a stretch wrapping machine may be configured to undertake a sequence of operations to release a used roll and load a replacement roll. Assuming that a particular load station is preloaded by an operator with a replacement roll and with a leading end of the web of packaging material on the roll wound around the various guide members and secured to the clamp, the controller may control the support arm to swing the carousel to a position proximate the stretch wrapping machine and may control the positioning mechanism to rotate the carousel to an angular position corresponding to the roll support of the load station that is configured to receive the used roll of packaging material currently on the packaging material dispenser. In addition, the controller may rotate the rotating ring to a loading position that orients the packaging material dispenser over the load station. In some embodiments, mechanical actuators may also be used to fix the rotating ring at the desired position, and the dispenser may be driven in a reverse direction to rewind onto the roll any packaging material that is still interposed within the packaging material dispenser, optionally using the aforementioned one-way clutch arrangement to substantially match the surface speeds of the pre-stretch rollers with one another. In addition, in some embodiments, the support shaft of the packaging material roll carrier may be biased to maintain a roll of packaging material in contact with the upstream pre-stretch roller of the packaging material such that rotation of the upstream pre-stretch roller drives the roll of packaging material, and as such, in some instances it may be desirable to actuate a release mechanism to move the packaging material roll carrier and separate the used roll from the upstream pre-stretch roller, e.g., through a swinging motion transverse to the longitudinal axis of the support shaft.

Next, the controller may lower the packaging material dispenser to a position that is still above the load station, and control the packaging material roll carrier to release the roll, causing the roll to drop onto the aligned roll support on the load station. Next, the controller may control the positioning mechanism to rotate the carousel to a position that aligns the replacement roll under the support shaft of the packaging material roll carrier, and then lower the packaging material dispenser further until the support shaft is fully inserted through the spool of the replacement roll and the various rollers are interposed within the tortuous path defined by the web of packaging material supported by the support members. Also during lowering of the packaging material dispenser, the retractable support peg in the load station may also be retracted from the spool due to contact with the lowering support shaft to permit the support shaft of the roll carrier to project fully through the spool. In addition, the packaging material dispenser may include a clamp that is disposed at an elevation that enables the clamp to, when actuated, grip the leading end of the web of packaging material. Once so positioned, the controller may actuate the packaging material roll carrier to extend the retractable support members and may actuate the peripheral support mechanism of the load station to drop the roll onto the retractable support members. Alternatively, the peripheral support mechanism may be released at a predetermined position of the support peg. At this time the support shaft of the packaging material roll carrier may also be released such that the roll contacts the upstream pre-stretch roller.

Next, the support members may be moved to their respective release positions to disengage from the web of packaging material and thereby release the web onto the plurality of rollers of the packaging material dispenser. Furthermore, in some embodiments, roughly concurrently with releasing the support members, the packaging material dispenser may be driven in a reverse/rewind direction to reduce slack and/or apply some tension to the web around the rollers, thereby reducing the likelihood of any portion of the web dropping below the elevation of the rollers and causing a misfeed in the packaging material dispenser. This rewind may be timed to be simultaneous with, somewhat after or even somewhat before releasing the support members in different embodiments. In addition, it will be appreciated that due to the slack being taken up in this manner, tolerance or spacing requirements between the guide members and the rollers may be relaxed, so even if the portion of the web supported by the guide members is significantly longer than the path through the plurality of rollers, the excess length may be rewound back onto the roll to reduce the chance that the web falls out from between the rollers.

Thereafter, the controller may raise the packaging material dispenser, and with the leading end of the packaging material clamped by the clamp on the packaging material dispenser and the web wound through the plurality of rollers, the packaging material dispenser may be ready to resume wrapping operations.

End of Roll Prediction

It may also be desirable in some embodiments to incorporate end of roll prediction functionality in a stretch wrapping machine, e.g., for use in connection with automatic roll change operations, as well as in other situations where it may be desirable to predict when the end of a roll of packaging material has been, or is about to be, reached.

Conventional stretch wrapper machines have traditionally operated until all of the packaging material has been dispensed from a packaging material roll. In many instances, the dispensing of all packaging material from a roll is treated in a similar manner to a film break, and a dancer bar or roller is used to detect both a film break and an empty roll based upon a lack of tension in the web of packaging material. Then, depending upon whether an automatic roll change system is used, the empty roll may be replaced with a new roll either automatically or manually, and if the last wrapping operation was halted prematurely, the last operation is repeated.

It has been found, however, that due to the manner in which some packaging material is initially wound about a core of a packaging material roll, a risk exists that packaging material at the very end of a packaging material roll may become lodged in a packaging material dispenser or otherwise require manual cleaning before wrapping can resume. Furthermore, in situations where packaging material is rewound back onto a packaging material roll, e.g., prior to an automatic roll change operation as described above, it has also been found that the manner in which some packaging material is initially wound about a core can also cause snap back of packaging material during a rewind operation, potentially leading to fouling of the packaging material dispenser with packaging material that generally must be removed before wrapping operations can resume.

Further, this risk of dispenser fouling is complicated by the competing concern for environmental and/or cost reasons to minimize the amount of wasted packaging material, as it is generally desirable to use as much of the packaging material on each roll as possible. Changing out a roll of packaging material when a substantial amount of packaging material remains on the roll may therefore increase overall costs and waste packaging material.

With some embodiments consistent with the invention, on the other hand, it may be desirable to predict the end of a roll of packaging material prior to all of the packaging material being dispensed from the roll, which will be referred to herein as an end of roll condition. Doing so may enable, for example, the remaining packaging material to be rewound onto the roll to enable an automatic or manual roll change operation to be completed, and to do so with a reduced risk of fouling the packaging material dispenser.

In some embodiments, for example, historical data may be used to predict when an end of roll condition is about to occur. For example, a length sensor may be used to track the amount of packaging material dispensed from each roll, and a future roll may be predicted to reach an end of roll condition based upon this historical data. It may also be desirable in some embodiments to average together multiple rolls (e.g., the last three rolls) and use the average to predict when a current roll has reached its end of roll condition. A length sensor for such tracking may be implemented in a number of different manners in different embodiments, e.g., by using an encoder or counter coupled to a roller of known circumference such that by tracking the number of revolutions of the roller, a length can be calculated. In some embodiments, the roller may be upstream of a pre-stretch assembly such that an actual length of packaging material dispensed from a roll can be tracked, while in other embodiments, revolutions of a pre-stretch roller or another roller downstream of the pre-stretch assembly may be tracked, as assuming a constant pre-stretch ratio is used from cycle to cycle, the amount of pre-stretched packaging material dispensed will be proportional to the actual amount of packaging material dispensed from each roll. Further, assuming the pre-stretch ratio is known for each cycle, the actual length of dispensed packaging material can be derived from the tracked length of pre-stretched packaging material.

In other embodiments, an end of roll condition may be predicted by tracking the current size/diameter/radius of the packaging material roll. For example, in some embodiments, a roller, e.g., an upstream pre-stretch roller or another driven or idle roller, may be configured to ride on the surface of the packaging material roll during a wrapping operation. As noted above, in some embodiments such a roller may be used to rewind a packaging material roll, and given that the diameter of a packaging material roll progressively decreases as packaging material is dispensed from the roll, generally such a roller is biased and configured to pivot or otherwise move in a direction generally transverse to its axis of rotation so as to ride along the surface of the packaging material roll regardless of the amount of packaging material on the roll. Thus, by tracking the transverse movement of the roller, the amount of packaging material left on the roll can also be tracked, e.g., to sense a distance of the roller surface from an axis of rotation of the packaging material roll.

Furthermore, the diameter or radius of the core of the packaging material roll can also be used in end of roll prediction. The diameter or radius may be determined in a number of manners, e.g., by sensing the diameter with a sensor, by manually measuring the core and entering the data into the machine or another computing device, or by using data received from a packaging material manufacturer. Further, in some embodiments, a teaching mode may be employed where an operator monitors when the end of a roll has been reached, and then hits a button or otherwise enters into the machine or another computer device an indication that the end of the roll condition has occurred, such that the current position of the roller riding on the packaging material roll can be captured. The captured value can then be used in subsequent wrapping operations for comparison with the position of the roller to detect future end of roll conditions.

It will be appreciated that an end of roll condition may be signaled when all packaging material has been dispensed from a roll, or in some embodiments, prior to dispensing all packaging material, e.g., when there are one or more layers of packaging material left on the roll. As such, a comparison based upon the diameter or radius of the core may also include the addition of a buffer distance from the core surface.

In addition, in some embodiments, rather than tracking the position of a roller riding on a packaging material roll value, a proximity switch may be used to signal an end of roll condition when the roller reaches a predetermined position. The proximity switch may be manually or automatically adjustable to accommodate different core sizes, and particularly when a stretch wrapping machine generally uses the same type of packaging material roll the position of a proximity switch may rarely, if ever, need to be adjusted.

In still other embodiments, an end of roll condition may be predicted by tracking the rotation rate of the packaging material roll, e.g., using an encoder, counter or other sensor configured to sense the rotation of the packaging material roll or of the support shaft of a packaging material roll carrier upon which the packaging material roll is mounted. In such an embodiment, the rotation rate and/or the surface speed of the roller that rides on the packaging material roll may also be tracked, e.g., using an encoder, counter or other sensor configured to sense the rotation of the roller. It will be appreciated that given a known diameter or radius of the roller that rides on the packaging material roll, the current diameter or radius of the packaging material roll can be derived from the rates of rotation of the roller and the packaging material roll, and thus this current diameter or radius can be compared against the diameter or radius of the core (determined in any of the manners discussed above) to determine when the end of roll condition has been reached.

In particular, assume a rotational rate of $R_r$ for a roller of diameter $D_r$ and a rotational rate of $R_{pm}$ for a packaging material roll of diameter $D_{pm}$. For the purpose of determining the diameter of the packaging material roll, the linear rate at which packaging material is dispensed by the packaging material roll may be considered to equal the linear rate at which packaging material is consumed by the roller, and given that the linear rate is based upon circumference (which is π times diameter), the following relationship is established:

$$R_{pm}\times(\pi D_{pm})=R_r\times(\pi D_r)$$

And thus:

$$D_{pm}=(R_r/R_{pm})\times D_r$$

Figure 13:
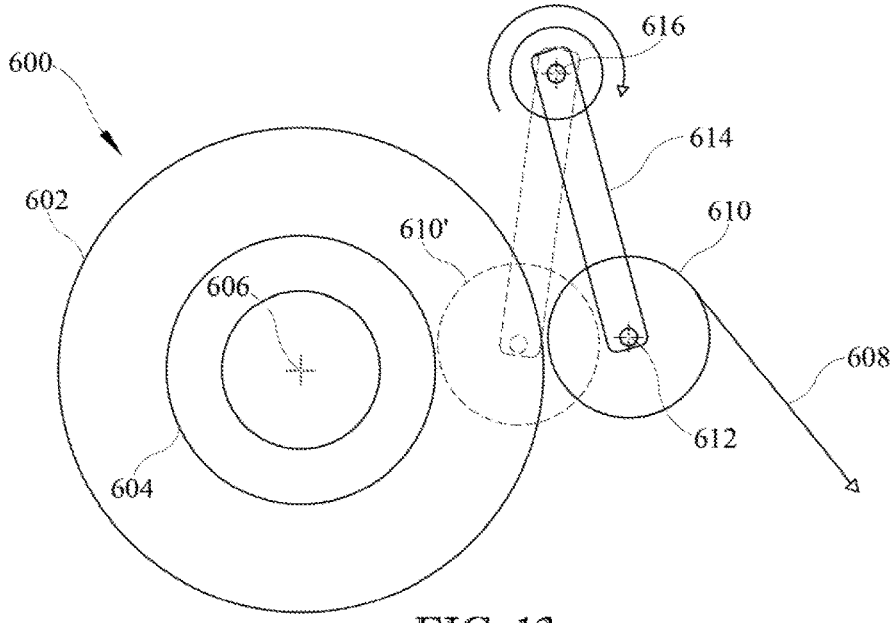
FIG. 13 is a functional top view illustrating an example end of roll prediction arrangement consistent with the invention.

FIG. 13, for example, illustrates an example end of roll prediction arrangement 600 suitable for use in a stretch wrapping machine consistent with the invention. Illustrated is a packaging material roll 602 including a core 604 and rotating about an axis of rotation 606. A web 608 of packaging material is dispensed by roll 602 and extends around a roller 610, which may be driven or idle, and in some embodiments, may be a pre-stretch roller. In one embodiment, for example, roller 610 is a driven roller that is about 2 inches in length and oriented about 4 inches from the top of the roll 602 along an axial direction, and is driven at a rate to provide a slightly slower surface speed than that of a pre-stretch roller through the use of a belt and pulley arrangement.

Roller 610 rotates about an axis of rotation 612 and is mounted to an arm 614 that pivots about an axis of rotation 616, and roller 610 and arm 614 are biased towards the surface of roll 602 to ride along the surface of roll 602 during operation. The bias may be provided by a spring, hydraulic pressure, or other biasing mechanism as will be appreciated by those of ordinary skill in the art having the benefit of the instant disclosure, and as noted above, rather than rotating or pivoting about axis of rotation 616 in a direction that is generally transverse to axis of rotation 612, roller 610 may also move in other directions (e.g., linearly) generally transverse to axis of rotation 612 when riding along the surface of roll 602. As packaging material is dispensed from roll 602, the diameter of roll 602 decreases, and roller 610 pivots towards core 604 of roll 602, and once the surface of roller 610 reaches core 604, or a minimal distance therefrom corresponding to one or more layers of packaging material still remaining on roll 602 (e.g., as illustrated at 610'), an end of roll condition may be predicted.

Figure 14:
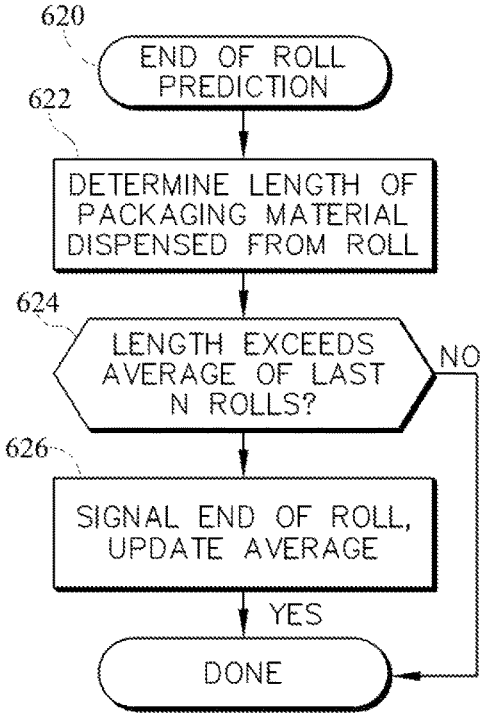
FIGS. 14 and 15 illustrate example routines for predicting an end of roll condition consistent with the invention.

As noted above, and with reference to end of roll prediction routine 620 of FIG. 14, in some embodiments, the prediction may be based on tracking the length of packaging material dispensed from roll 602, e.g., using an encoder or other sensor that monitors the rotation of roller 610. Since roller 610 is of a fixed diameter, the length of packaging material dispensed from roll 602 may be determined based upon the number of rotations and the circumference of roller 610. Thus, block 622 determines the length of packaging material dispensed from roll 602, and block 624 compares this length to the average of the last N rolls dispensed from the stretch wrapping machine. If the length exceeds the average, indicating that the end of roll condition has been met, control passes to block 626, and an end of roll condition is signaled. Furthermore, at this time the average of the last N rolls may be updated to include the length determined in block 622. Routine 620 is then complete. Returning to block 624, if the length does not exceed the average, indicating that the end of roll condition has not been met, block 626 is bypassed, and routine 620 is complete.

Figure 15:
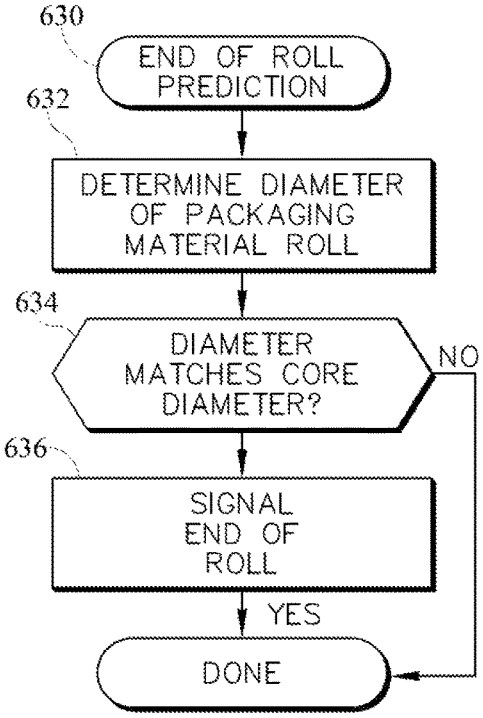

Now with reference to end of roll prediction routine 630 of FIG. 15, in other embodiments, an end of roll prediction may be based on tracking the diameter of the packaging material roll 602, and as such routine 630 begins by determining the current diameter of the packaging material roll 602. As noted above, the diameter may be determined in various manners in different embodiments. In some embodiments, for example, the position of roller 620 along its arcuate path circumscribing axis of rotation 616 may be determined, and based upon the known diameter of roller 620 and the known location of axis of rotation 606, a distance from the surface of roller 620 to the axis of rotation 606 may be determined, e.g., based upon the output of an encoder coupled to sense the degree of rotation of arm 614 about axis of rotation 616, or in other manners that will be apparent to those of ordinary skill having the benefit of the instant disclosure. In other embodiments, the diameter of roll 602 may be determined based upon a comparison of the rotation rates of roller 610 and packaging material roll 602.

Irrespective of how the diameter is determined, block 634 next determines if the current diameter matches the core diameter (which may include a buffer distance incorporated into the comparison). As noted above, the core diameter may be determined in a number of different manners, e.g., through a learning mode, manual entry, or automatic sensing. If the roll diameter matches the core diameter, indicating that the end of roll condition has been met, control passes to block 636, and an end of roll condition is signaled. Routine 630 is then complete. Returning to block 634, if the roll diameter does not match the core diameter, indicating that the end of roll condition has not been met, block 636 is bypassed, and routine 630 is complete.

It will be appreciated that routines 620 and 630 may be executed at different times in different embodiments. In some embodiments, for example, either routine may be executed at the beginning of each wrapping operation, and in some instances, a further determination may be made as to whether sufficient packaging material remains on the roll to complete the next wrapping operation. In other embodiments, either routine may be executed more frequently, e.g., on a periodic basis throughout each wrapping operation.

Other embodiments will be apparent to those skilled in the art from consideration of the specification and practice of the present invention. It is intended that the specification and examples be considered as exemplary only, with a true scope and spirit of the disclosure being indicated by the following claims.

What is claimed is:

1. A method of winding packaging material onto a packaging material dispenser roll by a pre-stretch device in a stretch wrapping machine, comprising:

providing relative rotation between a load and the packaging material dispenser roll about an axis of rotation to dispense packaging material to the load;

driving an upstream pre-stretch roller and a downstream pre-stretch roller by a drive motor;

slipping both an upstream pre-stretch pulley and an upstream rewind pulley of the upstream pre-stretch roller relative to the rotation of the upstream pre-stretch roller in an unwind direction of packaging material travel to dispense the packaging material to the load;

locking both the upstream pre-stretch pulley and the upstream rewind pulley of the upstream pre-stretch roller relative to the rotation of the upstream pre-stretch roller in a rewind direction of packaging material travel to wind the packaging material around the packaging material dispenser roll.

2. The method of claim 1, further comprising:

contacting the packaging material dispenser roll with the upstream pre-stretch roller to rotate the packaging material dispenser roll;

connecting a downstream pre-stretch pulley and a downstream rewind pulley to the downstream pre-stretch roller;

operatively connecting the downstream pre-stretch pulley with the upstream pre-stretch pulley; and operatively connecting the downstream rewind pulley with the upstream rewind pulley;

wherein the upstream pre-stretch roller rotates with a surface speed that is slower than the downstream pre-stretch roller in the unwind direction of packaging material travel and wherein the upstream pre-stretch roller rotates with a surface speed that is at least as fast as the downstream pre-stretch roller in the rewind direction of packaging material travel.

3. The method of claim 2, further comprising:

feeding the packaging material from the upstream pre-stretch roller to an idle roller and providing the packaging material from the idle roller to the downstream pre-stretch roller.

4. The method of claim 2, further comprising connecting the drive motor, the rewind pulley of the downstream pre-stretch roller and the rewind pulley of the upstream pre-stretch roller by a drive belt.

5. The method of claim 4, further comprising connecting the pre-stretch pulley of the downstream pre-stretch roller to the pre-stretch pulley of the upstream pre-stretch roller by a second belt.

6. The method of claim 5, further comprising locking the pre-stretch pulley of the downstream pre-stretch roller and the rewind pulley of the downstream pre-stretch roller relative to rotation of the downstream pre-stretch roller in both the rewind direction of packaging material travel and the unwind direction of packaging material travel.

7. The method of claim 6, wherein the pre-stretch pulley of the upstream pre-stretch roller rotates slower than the pre-stretch pulley of the downstream pre-stretch roller.

8. The method of claim 6, wherein the rewind pulley of the upstream pre-stretch roller rotates substantially equal to the rotation of the rewind pulley of the downstream pre-stretch roller.

9. The method of claim 2, further comprising providing at least one one-way clutch between the upstream pre-stretch roller and the upstream pre-stretch roller rewind and upstream pre-stretch roller pre-stretch pulleys.

10. A method of winding packaging material onto a packaging material dispenser roll by a pre-stretch device in a stretch wrapping machine, comprising:

providing relative rotation between a load and the packaging material dispenser roll about an axis of rotation to dispense a packaging material to the load;

passing the packaging material around an upstream pre-stretch roller and a downstream pre-stretch roller of the pre-stretch device;

rotating the upstream pre-stretch roller at a predetermined surface speed slower than that of the downstream pre-stretch roller during unwinding of the packaging material from the packaging material dispenser roll;

reversing the rotation direction of the upstream pre-stretch roller and downstream pre-stretch roller; and rotating the upstream pre-stretch roller at a predetermined surface speed substantially equal to that of the downstream pre-stretch roller during winding of the packaging material onto the packaging material dispenser roll when the rotation direction of the upstream pre-stretch roller and downstream pre-stretch roller is reversed.

11. A method of winding packaging material onto a packaging material dispenser roll by a pre-stretch device in a stretch wrapping machine, comprising:

providing relative rotation between a load and the packaging material dispenser roll about an axis of rotation to dispense a packaging material to the load;

pre-stretching the packaging material in a pre-stretch device, the pre-stretch device having an upstream pre-stretch roller and a downstream pre-stretch roller;

operatively connecting the upstream pre-stretch roller with the downstream pre-stretch roller in a packaging material unwind direction to rotate the downstream pre-stretch roller with at a higher surface speed than that of the upstream pre-stretch roller to pre-stretch the packaging material; and operatively connecting the upstream pre-stretch roller with the downstream pre-stretch roller in a packaging material rewind direction to rotate the upstream pre-stretch roller at a surface speed substantially equal to that of the downstream pre-stretch roller to rewind the packaging material on the packaging material dispenser roll.

12. The method of claim 11, further comprising driving by a drive motor the downstream pre-stretch roller and the upstream pre-stretch roller.

13. The method of claim 12, further comprising:

providing the downstream pre-stretch roller with a first and a second pulley, the first pulley having a diameter smaller than that of the second pulley;

providing the upstream pre-stretch roller with a first and a second pulley, the first pulley having a diameter smaller than that of the second pulley;

connecting the first pulley of the downstream pre-stretch roller with the second pulley of the upstream pre-stretch roller; and connecting the second pulley of the downstream pre-stretch roller with the first pulley of the upstream pre-stretch roller.

14. The method of claim 13, wherein the connecting is by a belt.

15. The method of claim 13, further comprising freely rotating the first and second pulley of the upstream pre-stretch roller when the upstream pre-stretch roller is rotating in the unwind direction.

16. The method of claim 15, further comprising locking the first and second pulley of the downstream pre-stretch roller to the downstream pre-stretch roller.

17. The method of claim 13, further comprising interposing an idle roller between the upstream pre-stretch roller and the downstream pre-stretch roller to receive the packaging material from the upstream pre-stretch roller.

18. The method of claim 13, further comprising operatively connecting the drive motor to the second pulley of the downstream pre-stretch roller and the first pulley of the upstream pre-stretch roller.

19. The method of claim 13, further comprising:

locking the first and second pulley of the downstream pre-stretch roller to the rotation of the downstream pre-stretch roller in both the rewind and the unwind direction;

locking the first and second pulley of the upstream pre-stretch roller to the rotation of the upstream pre-stretch roller in the rewind direction and slipping the first and second pulley in relation to the rotation of the upstream pre-stretch roller in the unwind direction.

20. A pre-stretch dispensing apparatus allowing rewind of a packaging material web dispensed by a dispensing roll, comprising:

an upstream pre-stretch roller receiving the packaging material web from the dispensing roll and in contact with the dispensing roll, the upstream pre-stretch roller affixed to an upstream pre-stretch roller shaft, the upstream pre-stretch roller shaft operatively connected to an upstream pre-stretch pulley and an upstream rewind pulley;

a downstream pre-stretch roller receiving the packaging material web from the upstream pre-stretch roller, the downstream pre-stretch roller affixed to a downstream pre-stretch roller shaft, the downstream pre-stretch roller shaft operatively connected to a downstream pre-stretch pulley and a downstream rewind pulley; and a motor operatively connected to the downstream rewind pulley and the upstream rewind pulley;

wherein the downstream pre-stretch pulley is operatively connected to the upstream pre-stretch pulley;

the upstream pre-stretch pulley and the upstream rewind pulley freely rotate relative to the upstream pre-stretch roller shaft when rotating in a forward dispensing direction and are locked to the rotation of the upstream pre-stretch roller shaft in a rewind direction.

21. The pre-stretch dispensing apparatus of claim 20, wherein at least one one-way clutch is interposed between the upstream pre-stretch roller shaft and the upstream pre-stretch pulley and the upstream rewind pulley.

22. The pre-stretch dispensing apparatus of claim 20, wherein a first one-way clutch is interposed between the upstream pre-stretch roller shaft and the upstream pre-stretch pulley and a second one-way clutch is interposed between the upstream pre-stretch roller shaft and the upstream rewind pulley.

23. The pre-stretch dispensing apparatus of claim 20, wherein the downstream rewind pulley and the downstream pre-stretch pulley are locked to the downstream pre-stretch roller shaft.

24. The pre-stretch dispensing apparatus of claim 20, further including an idle roller interposed between the upstream pre-stretch roller and the downstream pre-stretch roller, the idle roller receiving the packaging material web from the upstream pre-stretch roller.

25. The pre-stretch dispensing apparatus of claim 24, wherein the idle roller is biased outward away from a rotational axis of the upstream pre-stretch roller shaft.

26. The pre-stretch dispensing apparatus of claim 20, wherein the upstream rewind pulley has a diameter at least as large as a diameter of the downstream rewind pulley.

27. The pre-stretch dispensing apparatus of claim 26, wherein the upstream rewind pulley is substantially the same diameter as the downstream rewind pulley.

28. The pre-stretch dispensing apparatus of claim 20, wherein a drive belt operatively connects the motor to the downstream rewind pulley and the upstream rewind pulley.

29. The pre-stretch dispensing apparatus of claim 20, wherein a pre-stretch belt operatively connects the downstream pre-stretch pulley and the upstream pre-stretch pulley.

30. A pre-stretch dispensing apparatus for use in stretch wrapping a load with packaging material, comprising:

a packaging material dispenser for dispensing packaging material, the packaging material dispenser configured to support a packaging material roll;

an upstream pre-stretch roller and a downstream pre-stretch roller receiving the packaging material from the packaging material roll;

the upstream pre-stretch roller and the downstream pre-stretch roller rotatable for pre-stretching of the packaging material, the upstream pre-stretch roller operatively rotatable with the downstream pre-stretch roller to rotate with a slower surface speed than that of the downstream pre-stretch roller in a forward wrapping direction;

the upstream pre-stretch roller rotatable with the downstream pre-stretch roller for rewind of the packaging material, the upstream pre-stretch roller operatively rotatable with the downstream pre-stretch roller to rotate with a surface speed substantially equal to that of the downstream pre-stretch roller in a rewind direction.

31. The pre-stretch dispensing apparatus of claim 30, wherein an upstream pre-stretch pulley of the upstream pre-stretch roller is connected by a belt to a downstream pre-stretch pulley of the downstream pre-stretch roller.

32. The pre-stretch dispensing apparatus of claim 31, wherein the upstream pre-stretch pulley is larger in diameter than the downstream pre-stretch pulley.

33. The pre-stretch dispensing apparatus of claim 32, wherein the upstream pre-stretch roller has a rewind pulley connected to a rewind pulley of the downstream pre-stretch roller.

34. The pre-stretch dispensing apparatus of claim 33, wherein the rewind pulley of the upstream pre-stretch roller is connected to the rewind pulley of the downstream pre-stretch roller by a belt.

35. The pre-stretch dispensing apparatus of claim 33, wherein the upstream pre-stretch roller rewind pulley and the downstream pre-stretch roller rewind pulley are connected to a motor.

36. The pre-stretch dispensing apparatus of claim 33, further including a one-way clutch interposed between both the upstream pre-stretch roller rewind pulley and the upstream pre-stretch roller pre-stretch pulley and an upstream pre-stretch roller shaft, the one-way clutch allowing both the rewind pulley and the pre-stretch pulley to freely rotate relative to the upstream pre-stretch roller shaft when rotating in the forward wrapping direction.

37. The pre-stretch dispensing apparatus of claim 36, wherein both the downstream pre-stretch roller pre-stretch pulley and downstream pre-stretch roller rewind pulley are keyed to the rotation rate of the downstream pre-stretch roller.

38. An apparatus for wrapping a load with packaging material and allowing rewind of the packaging material, comprising:

a packaging material dispenser for dispensing packaging material;

a rotational drive configured to provide relative rotation between the packaging material dispenser and the load; and a pre-stretch assembly arranged to receive the packaging material and dispense pre-stretched packaging material, the pre-stretch assembly including:

an upstream pre-stretch roller and a downstream pre-stretch roller, the upstream pre-stretch roller receiving packaging material from the packaging material dispenser and providing the packaging material to the downstream pre-stretch roller;

the upstream pre-stretch roller and the downstream pre-stretch roller rotatable to pre-stretch the packaging material in a forward direction, the upstream pre-stretch roller rotating with a slower surface speed than that of the downstream pre-stretch roller in the forward direction;

the upstream pre-stretch roller and the downstream pre-stretch roller rotatable to rewind the packaging material in a reverse direction, the upstream pre-stretch roller rotating with a surface speed substantially equal to the downstream pre-stretch roller in the reverse direction.

39. The apparatus of claim 38, wherein the upstream pre-stretch roller has a pre-stretch pulley and a rewind pulley, both the pre-stretch pulley and the rewind pulley keyed to the upstream pre-stretch roller in the reverse direction, both the pre-stretch pulley and the rewind pulley freely rotating relative to the upstream pre-stretch roller in the forward direction.

40. A packaging material dispenser, comprising:

a packaging material roll carrier configured to support a roll of packaging material;

upstream and downstream pre-stretch rollers positioned to receive a web of packaging material from the roll of packaging material supported by the packaging material roll carrier; and a drive mechanism operatively coupling the upstream and downstream pre-stretch rollers to one another to dispense the web of packaging material to a load, the drive mechanism including a one-way clutch arrangement coupled to the upstream pre-stretch roller such that the upstream pre-stretch roller rotates in one direction and with a slower surface speed than that of the downstream pre-stretch roller when dispensing the web of packaging material to the load to pre-stretch the web of packaging material, and wherein the drive mechanism is configured to drive the upstream pre-stretch roller in an opposite direction and with substantially the same surface speed as that of the downstream pre-stretch roller when rewinding the web of packaging material onto the roll of packaging material.

41. The packaging material dispenser of claim 40, further comprising a bias mechanism coupled to the packaging material roll carrier to bias a surface of the roll of packaging material against the upstream pre-stretch roller such that the roll of packaging material is driven by the upstream pre-stretch roller when the drive mechanism drives the upstream pre-stretch roller in the opposite direction.

* * * * *